US011286667B2

(12) United States Patent
Giles

(10) Patent No.: US 11,286,667 B2
(45) Date of Patent: Mar. 29, 2022

(54) SEISMIC FOUNDATION FRAMER AND METHOD OF FORMING A FOUNDATION USING SAME

(71) Applicant: Armatron Systems, LLC, Sedona, AZ (US)

(72) Inventor: Brian C. Giles, Sedona, AZ (US)

(73) Assignee: ARMATRON SYSTEMS, LLC, Scottsdale, AZ (US)

( * ) Notice: Subject to any disclaimer, the term of this patent is extended or adjusted under 35 U.S.C. 154(b) by 0 days.

(21) Appl. No.: 16/768,877

(22) PCT Filed: Dec. 1, 2018

(86) PCT No.: PCT/US2018/063519
§ 371 (c)(1),
(2) Date: Jun. 1, 2020

(87) PCT Pub. No.: WO2019/109056
PCT Pub. Date: Jun. 6, 2019

(65) Prior Publication Data

US 2021/0047832 A1 Feb. 18, 2021

Related U.S. Application Data

(60) Provisional application No. 62/593,363, filed on Dec. 1, 2017.

(51) Int. Cl.
*E04C 5/16* (2006.01)
*E02D 31/08* (2006.01)
*E04C 5/06* (2006.01)

(52) U.S. Cl.
CPC ..... *E04C 5/163* (2013.01); *E02D 31/08* (2013.01); *E04C 5/0609* (2013.01)

(58) Field of Classification Search
CPC ..... E04C 1/163; E04C 5/0609; E04C 5/163; E04C 5/168; E02D 31/08
(Continued)

(56) References Cited

U.S. PATENT DOCUMENTS 7,108,453 B2 * 9/2006 Harris ..... E01C 11/18 404/135
7,810,298 B1 10/2010 Sorkin
(Continued)

FOREIGN PATENT DOCUMENTS

WO WO-2019109056 A1 * 6/2019 ..... E04C 5/0604

*Primary Examiner* — Christine T Cajilig
(74) *Attorney, Agent, or Firm* — Invention To Patent Services; Alex Hobson

(57) ABSTRACT

A plurality of seismic foundation frames are utilized to secure rebar in a fixed location to produce a cementitious supporting form that is embedded in the poured concrete and reinforces the concrete. The frame has an open construction with a plurality of openings to allow the concrete to flow therethrough and to provide increased surface area for reinforcement. The frame has pin openings and rebar openings for receiving and retaining pins or rebar respectively, such as when the frames are stacked. A frame has rebar retainers for retaining rebar that extends perpendicularly to the surface of the frame to a second frame at an offset distance. A flexible containment sleeve is configured around the frames and may be fastened to the frame to create a sleeved form for receiving a cementitious mix. The containment sleeve has apertures for controlled permeation to control the rate of cure of the cementitious mix.

21 Claims, 21 Drawing Sheets

(58) Field of Classification Search
USPC ..... 52/646
See application file for complete search history.

(56) References Cited

U.S. PATENT DOCUMENTS

| | | | | |
|---|---|---|---|---|
| 9,365,999 | B1 | 6/2016 | Jordan et al. | |
| 2006/0099032 | A1 | 5/2006 | Harris | |
| 2007/0126155 | A1 | 6/2007 | Korwin-Edson et al. | |
| 2008/0028718 | A1 | 2/2008 | Erickson et al. | |
| 2009/0100784 | A1 | 4/2009 | Garza et al. | |
| 2009/0249725 | A1 | 10/2009 | McDonagh | |
| 2011/0214382 | A1 | 9/2011 | Alfonso | |
| 2013/0074432 | A1 | 3/2013 | Ciuperca | |
| 2014/0033638 | A1 | 2/2014 | Goerger et al. | |
| 2014/0069047 | A1* | 3/2014 | Podjadtke ..... | E21D 11/107 52/693 |
| 2015/0375420 | A1 | 12/2015 | Sakata et al. | |

* cited by examiner

PRIOR ART

SEISMIC FOUNDATION FRAMER AND METHOD OF FORMING A FOUNDATION USING SAME

CROSS REFERENCE TO RELATED APPLICATIONS

This application is a national stage entry application of PCT application No. PCT/US2018/63519, filed on Dec. 1, 2018, which claims the benefit of U.S. provisional patent application No. 62/593,363, filed on Dec. 1, 2017; the entirety of which is hereby incorporated by reference herein.

BACKGROUND OF THE INVENTION

Field of the Invention

The present invention is directed to seismic foundation frame, a cementitious supporting form made therefrom and methods of making and using the form.

Background

This present disclosure pertains to foundations and methods of preparing and producing a foundation. Installation of a foundation, for even a modest-sized structure, usually requires the time and efforts of numerous specialized trades and individuals, presenting the added challenge of organizing numerous specialized individuals to cooperate in an efficient manner. Despite the availability of modern construction machinery such as cranes, pumps, concrete mixers, and form works, the construction industry is currently dependent primarily on manual labor of professional contractors that operate the machinery and tools. Thus, current concrete construction is very costly and time consuming.

These skilled laborers construct structures using expensive methods and materials, such as reinforced concrete and masonry forms, that are generally rectilinear, thus significantly restricting architectural designs. Thus, these costs increase significantly when constructing complex concave-convex surfaces, for example, that conventionally require the pre-construction of expensive formworks and iron reinforcement cages, further including their transport, assembly, and then casting. Additionally, virtually all conventional construction systems require skilled workers to constantly refer to site plans (blue-prints), and this practice is slow and expensive, often producing inconsistent results. The appearance and quality of one structure can vary from another built from the same site plans and materials.

Regulations require reinforcement of concrete structures with rebar and/or other structural materials. Preparation and accurate layout of these cementitious reinforcing structures is time consuming and difficult. For foundations, long pieces of rebar are typically configured along a length of the foundation and are tied together at intersections with wire-tie, by hand. This is an imprecise method and the rebar can shift out of its stress zone when the concrete is poured leading to structurally weak areas that are prone to cracking and failure under load. Concrete walls and other vertical structures also require reinforcement. Again, extended lengths of rebar are configured vertically and horizontal extended rebar is commonly tied to the vertical rebar. This is a very difficult process and accurate retaining the rebar in pre-engineered stress zone during pouring of the concrete is difficult as the rebar may shift in position thereby loosing accuracy of the position of the rebar conventionally. Concrete forms are typically used to define the perimeter location of a poured concrete structure. These forms are usually constructed on site out of wood and require support structures to prevent collapse of the forms from the weight of the concrete. Again, this is a very labor-intensive process and requires additional materials to be brought to and removed from the work-site.

Historically, casting concrete foundations has necessitated the erection of two structures (forms): first; wooden, plastic, or foam forms are purchased, transported, assembled, and secondly; the concrete mix is poured or sprayed and is temporarily held in place by such forms. Following this, the forms are removed, and discarded or recycled, or cleaned, reshipped, stored and inventoried (Reference FIG. 1). Restraining posts are additionally often custom fabricated and assembled on site to shape, size, and define the walls. After the concrete mix has been poured into the assembled fixed form and has sufficiently cured, the form(s) are disassembled and other forms are then constructed for any adjacent wall sections. This process often requires the bottom edge of the form being positioned in place with stakes (Reference FIG. 1), and tilting them towards the vertical side of the fixed forms, further using wood spacers to separate the tops of the fixed forms at the desired distance (Reference FIG. 1), and often hold the fixed forms against the spacers with tie wire (not shown), further having the conventional challenges of constructing a rebar reinforcing cage inside such forms.

Additionally, these forms are usually flat, thus significantly limiting design and construction diversity. Furthermore, conventional concrete forms have undesirable insulative characteristics that produce uneven heat dissipation during curing that can degrade the potential quality of the mixes' performance, and further limiting the critical factors required for obtaining the highest performance potential of concrete mixes. Furthermore, these conventional forms do not allow for visual inspection of the concrete mix casting state and quality, such as not revealing air pockets, voids, "bug holes", etc., nor do they sufficiently protect the mix cast from the exterior environment, such as rain, driven wind, snow, debris, etc.

Within the prior art, using manual labor for construction is often very time-consuming, often requiring several months and, in some instances years, to complete. This can be due to differences in the laborers' skills, tolerances, sites, supervision, and techniques employed by those that work on the structures. Another important consideration is that conventional concrete construction systems typically result in significant amounts of wasted materials and time. For example, when concrete forms are used, they are commonly purchased in standardized off-the-shelf sizes, and often must be cut to meet site design requirements, resulting in waste of materials, labor, and time. Further, the materials require purchasing, inventorying, storage, and transportation, including their cleaning and discarding, or storage for subsequent re-use A further limitation of prior art is the extensive and expensive site preparation required to accommodate the linear rigidities imposed by current methods. The concrete construction industry has a need for more sustainable automated onsite constructions systems that provides improved efficiencies, including use of building sites, and further providing significant improvements in sustainability durability, such as from seismic, wind, and snow load stability.

Additionally, within the prior art, constructing structures having complex multi-curved foundations and walls, particularly constructing with multiple temporary curved concrete forms for casting concrete walls, particularly those with small radiuses, is problematic and is cost prohibitive.

Materials such as reinforced concrete can be molded into curved structures, however conventional systems require costly individualized concrete forms to shape and support such materials in their initial fluid or plastic state. Since concrete forms have been generally constructed of lumber, it has been simpler and more economical to maintain the inherent rectilinear shape in the fabrication of such concrete forms and hence rectilinear concrete structures. Assembly of wooden forms in complex curved shapes requires a great expenditure of materials, cost, time, and effort.

Traditionally, buildings have been erected in generally rectangular configurations with the use of lumber, bricks, blocks and the like. These are rigid materials and may be most easily produced with straight sides and square corners, which requires that structures built with such materials also have the same straight sides and square corners of rectangular configurations. Structures built from conventional wood frame materials generally have relatively low energy efficiency and require a high level of maintenance. And tend to be fragile, and are susceptible to damage from storms, floods, earthquakes, and fire than are other reinforced concrete structures with curvilinear geometries.

In the art, it is known that curvilinear structures having complex 3-dimensional foundations and shapes such as having arches, domes, and vaults provides stress displacements and other numerous engineering benefits in structural integrity, air circulation, and aesthetics and design flexibility. 3-dimensional printed structures constructed with curved walls generally have higher potential resistance from earthquakes, high winds, snow loads, and the like, and additionally may be more energy efficient. However, the construction of such complex curvilinear structures has previously been unwanted or problematic and cost prohibitive.

The foundation framer rebar positioning system of the current invention provides the construction industry with more sustainable, and more ecological construction technology that constructs superior reinforced structures at lower time and costs, producing significantly less onsite waste and associated clean up, and employing more environmentally friendly materials, and requiring very low levels of energy. Employing concrete, the world's most ubiquitous material of our modern civilization, full architectural scale 3D concrete printing could herald an expansion to the $3^{rd}$ industrial revolution: The Era of Mass Customization Construction.

SUMMARY OF THE INVENTION

The invention is directed to a seismic foundation framer, cementitious supporting form made therefrom and methods of using the cementitious supporting form to create a strong and durable composite cementitious form. An exemplary seismic foundation framer, or frame as used herein, comprises a ribbon that extends around the perimeter to form a rectangular shaped frame. The frame has an open construction with a plurality of openings to allow the concrete to flow therethrough and to provide increased surface area for concrete bonding and improved reinforcement. The frame may comprise a plurality of pin openings, and rebar openings for accurately receiving and positioning and retaining structurally reinforcing pins and or rebar respectively. These openings may be used to align a first frame with a second frame. For example, a first frame may be configured as a base frame and a second frame may be configured on top of the base frame and a pin and/or rebar may be extended through aligned openings in the top and base frames to align the frames and secure them in alignment, even when concrete is poured. In addition, the rebar and/or pin extending through adjacent frames may provide additional structural support, and provides an integrative structurally reinforced component. It is to be understood that frames may be coupled by rebar and/or pin at some offset distance from each other to create a cementitious supporting form that may include a containment sleeve for receiving and retaining a cementitious material therein. An exemplary seismic foundation framer may also comprise other openings through the ribbon, such as fastener opening for attachment of fasteners, such as hog rings to secure a containment sleeve thereto. Additional openings allow cementitious material to flow through the seismic foundation framer to further improve strength and integration with the cementitious material. An exemplary seismic foundation framer may comprise threaded openings for receiving a threaded component, such as a structural component, or a fastener, such as a bolt, threaded sill bolt, or screw pile bolt, for example.

An exemplary seismic foundation framer comprises a plurality of rebar retainers for accurately positioning and retaining rebar with a length axis of the rebar extending through the frame, from a first surface to the second surface, or substantially perpendicular to the plane of the frame, in one embodiment. An exemplary rebar retainer is formed from a portion of the ribbon that extends inward from the perimeter to form a rebar receiving channel with a channel loops at the extend end of the receiving channel. Rebar may be located in a channeled receiving opening in the outer perimeter of the frame and slid along the channel to the channel loop or extended end of the channel. The channel preferably comprises a retaining protrusion that extends inward toward the channel from the outside surface of the ribbon to create an interference fit for accurately and securely retaining the rebar in the rebar retainer. The protrusions effectively reduce the width of the rebar receiving channel thereby requiring the rebar receiving channel to slightly flex and open for the rebar to snap into to the rebar retainer. The rebar may be forced past the retaining protrusion and into the rebar retainer which may be configured at the extend end of the rebar receiving channel. The rebar retainer may be geometrically shaped to accurately position and secure the rebar therein, wherein the rebar retainer extends at least 180 degrees about the rebar, when the rebar is circular in cross-sectional shape. In an exemplary embodiment, the rebar retainer extends more than 180 degrees about the rebar, thereby forming the retaining protrusion along the channel, such as about 190 degrees or more about, about 210 degrees or more, about 240 degrees or more, no more than about 250 degrees and any range between and including the values provided. Rebar retainers may be configured to secure rebar at an offset distance from the outer perimeter.

An exemplary rebar retainer retains rebar at an offset from the outer perimeter frame. The channel loop or extended end of the channel may be configured at a setback distance to meet codes and regulations for the setback of the rebar. For example, side setback distances for the rebar or the channel loop of the rebar retainer may be between about 1.5 inches (3.81 cm) to 1.75 inches (4.45 cm), and the top and bottom setbacks may be a minimum of about $3/8^{th}$ inch (0.95 cm) if depth is less than or equal to 8 inches (20.32 cm); and the required minimum concrete cover is ½ inch (1.27 cm) if depth is more than 8 inches (20.3 cm) according to ACI Building Code. These offset distances may be scaled and configured as needed to meet applicable codes or regulations, as required. In addition, a seismic foundation framer may have rebar receiving retainers with a reinforcing density that meets and/or exceeds regulations.

An exemplary frame may be configured with rebar retainers at a density of about one per square foot or more, about two per square foot or more, about four per square foot or more, about six per square foot or more, about eight per square foot or more, and any range between and including the rebar density provided. Rebar spacing's may be adjusted as needed and may vary depending upon application and as needed to conform with engineering requirements and applicable codes.

An exemplary seismic foundation framer may have a length or width that is at least about 6 inches, 15.24 cm, or more, at least 10 inches, 25.4 cm, or more, at least about 20 inches, 50.8 cm, or more and any suitable range between and including the dimensional values provided. The frame thickness ranges between about 1/16 inch (1.58 mm) up to about 1/2 inch (12.7 mm), more preferably ranging between about 1/8 inch (3.18 mm) to 1/4 inch (6.35 mm), and may be scaled as needed depending upon application and applicable regulations. As an option or optionally the rebar foundation frame may be scaled as needed depending upon application.

A plurality of seismic foundation framers may be coupled directly together to create a seismic foundation frame assembly, wherein the plurality of seismic foundation framers are directly adjacent to each other or touching each other. The plurality of seismic foundation framers may be secured to each other by a fastener, such as a wire tie, zip tie, or bull nose securement ring, for example. The plurality of seismic foundation framers may be configured next to each other and/or one atop another.

Rebar may be a rod that is substantially rigid or a cable that is more flexible. Rebar may be polypropylene, Basalt, metal, and the like. A preferred rebar may be made of high temperature composite basalt which will has a coefficient of thermal expansion (CTE) that is very close to that of most cementitious mixes and provides improved tensile strengths that is twice that of steel reinforcement(s) and has improved mechanical strength gains, thermal stability, having significantly higher corrosion resistance and is compatible with a wide variety of additives, aggregates, admixtures, resins, and epoxies while simultaneously providing an electromagnetic insulator, particularly, solid composite basalt or advanced hollow basalt bars. The fusion point for basalt is about 984 to 1260 degrees C.

The seismic foundation framer systems is compatible with a wide variety of pre and post tensioning systems. Rebar and cables maybe coupled to or attached between a first and a second seismic foundation framer and tensioned between them. Rebar or other structural components may be attached with a fastener or may be threaded into a threaded opening in the seismic foundation framer.

An exemplary seismic foundation framer may be made out of a polymeric material, such as a polyolefin including, but not limited to basalt, fiberglass and or carbon fiber, and or plastic material selected from the group consisting of, polypropylene, polyethylene, polytetrafluoroethylene, polybutylene, terephthalate, polyamides, polyester, linear low density polyethylene, medium density polyethylene, high density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), basalt, silk, further including carbon, fiberglass, stainless steel, para-aramid synthetic fiber, Kevlar, graphene and their variances or other natural or hybrid materials and mixtures thereof. Polypropylene and basalt materials are most preferred. An exemplary seismic foundation framer made be made out of a thermoplastic material such as Polypropylene, thereby enabling melt forming of the frame. A preferred seismic foundation framer may be made out of basalt material which has high strength and a similar coefficient of expansion as cementitious mixes. As an option the seismic foundation framer of the current invention may be made out of reinforced concrete.

In addition, the surface of the frame may have surface deformations that improves the interface bond with a wide variety of concrete mixes. A smooth surface of the frame may be more likely to be a cleavage plane with the concrete and is not preferred. The surface of an exemplary frame may have an average surface roughness of about 0.2 mm or more, 0.5 mm or more, 1 mm or more, about 2 mm or more, about 4 mm or less and any range between and including the surface deformations values provided. Surface roughness may be measured with a surface profilometer, such as available from Zygo Inc. or Keyence Corporation.

As an option the seismic foundation frame of the current invention may comprise printed material thereon, such as logos, trademarks, and further include embedded computer chips (such as for accurately locating in 3-dimensional space), dimensional features and the like.

An exemplary seismic foundation framer provides many advantages and benefits over the prior art. An exemplary seismic foundation framer provides previously unavailable reduction or elimination of rebar dislodgment, moving out of place, particularly during the mix pour phase/process, and further reduces the formation of voids; i.e. cavities/bug holes. The seismic foundation framer provides previously unavailable higher potential resistance from earthquakes, high winds, snow loads, etc., further including improved load bearing characteristics. The seismic foundation framer of the current invention eliminates the need for hangers on a conventional form, significantly improves the casting environment, eliminates the need to install attachments within conventional forms. The current invention significantly expands the performance quality and significantly expands the range of castable cementitious mixes and other materials over the prior art, further including their associated admixtures and aggregates, etc. Instead of many prior art concrete and rebar spacing components accomplishing the task, the simplified seismic foundation framer of the current invention reduces it to one light-weight component to quickly accomplish multiple prior art tasks. The seismic foundation framer is compatible with a wide variety of prior art reinforcing and other conventional systems, and as an option the seismic foundation framer may be dropped in or inserted and positioned into a conventional prior art "mold" forms.

Cementitious Supporting Form

A plurality of seismic foundation framers may be spaced apart from each other and coupled together by rebar retained in and extending from rebar retainers to form an exemplary cementitious supporting form. The frames may be offset from each other by about 5 inches (12.7 cm), or more, about 6 inches (15.24 cm) or more, about 10 inches, (25.4 cm) or more, about 20 inches, (50.8 cm) or more, about 30 inches, (76.2 cm) or more and any suitable range between and including the frame offset distances provided. Frame spacing's may be adjusted as needed and may vary depending upon application and as needed to conform with engineering requirements and applicable codes. Note that when a cable type of rebar is used, the frame offset distances may be shorter than when rebar rod is used. The rebar cable and rebar rod may extend straight between frames or may extend such that the consecutive frames are not linearly aligned. The rebar cable or rod may bend between the frames to enable the formation of curvilinear structures. The seismic foundation system may comprise additional structurally reinforcing components such as structural reinforcing pins or other rebar extending through pre-engineered openings in the frame. The rebar or pins may extend out from any of the sides, and/or the top or bottom of the frame.

Note that the top of the frame may optionally serve as receiving channels for smaller diameter rebar, that may be employed or adjusted to maintain an accurate curvature and/or combined with a straight line of the foundation, or any combination as needed. As an option, employing stakes to bend the reinforcement and maintain the desired pre-bent position, such as staking both sides of a foundation, particularly when making small radiuses.

Pins may be positioned and secured within the seismic foundation framer such as by gluing, such as Epoxy® having a quick curing time. Pins may be secured in position by smaller reinforcement rods that extend into an opening in the pin and in some cases through an opening in the seismic foundation framer to eliminate any rotation of the structural pin. An exemplary structural pin may have any suitable length, such as between about 3 inches (7.62 cm) to about 6 feet (183), more preferably ranging between about 6 inches (15.24 cm) to 3 feet (91 cm), or as needed depending upon application. Optionally the structural pins can be threaded to be removably attached to a variety reinforcement member such as seismic stirrups, seismic hooks.

As an option the seismic foundation framer encompasses creating an interlocking keyway (male and female keyways) such as by the insertion of, such as but not limited to, a removable mold preferably having a sphere or an elongated dome on one or both ends to be inserted in the top center receiving channel of the seismic foundation framer. The pin could be a male keyway for a subsequent structure formed on top—or it could be a female keyway formed by a keyway form that is replaced temporary or reusable.

The current invention encompasses as an option having seismic hooks and or seismic stirrups positioned and secured in one of many possible configurations, depending on the specific application and/or regulations.

In addition, the seismic foundation framer system may comprise multiple levels of frames, wherein seismic foundation framers are positioned and stacked one atop another and secured together with wire-ties, structural pins, bullnose ring, glue, staple, etc. Intersecting forms may also be created, such as at corners or in junctions, such as T-junctions.

Containment Sleeve

An exemplary seismic foundation framer system comprises a flexible containment sleeve that extends along the sides and under the bottom of the frames. The sleeve may be a material that is specifically designed to provide permeation rates for the proper optimized curing rate of the particular cementitious mix employed, and is additionally compatible with fiberglass, carbon, rebar, etc. The reinforcing containment sleeve may comprise a woven fabric for example, such as a polymeric fabric. An exemplary containment sleeve may be composed of basalt and or plastic material selected from the group consisting of, polypropylene, polyethylene, polytetrafluoroethylene, polybutylene, terephthalate, polyamides, polyester, linear low density polyethylene, medium density polyethylene, high density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), basalt, silk, further including carbon, fiberglass, stainless steel, Kevlar®, graphene and their variances or other natural or hybrid materials and mixtures thereof. Polypropylene and basalt materials are preferred due to their compatibility with cementitious materials, durability as they do not oxidize like many metals, strength and density.

An exemplary containment sleeve may be fastened to the seismic foundation framer by securing clips, hog rings, stapler, glue, wire-tie, glue, etc. The containment sleeve extends around and under a plurality of frames to create a cementitious supporting form for receiving a cementitious material. In one embodiment, the sleeve is fastened to the frame by securing rings that pierce through the sleeve and around a portion of the frame having previously unavailable accurate 3-dimensional space defining means, such as for a foundation and or wall, and has a variety of attachments such as but not limited to gluing, stapling, hog ring securement, wire-tying, and further provides ease of attachment for a wide variety of cladding to the pre-engineered attachment points (holes/receiving channels) of the seismic foundation framer. Stainless steel hog rings are most preferred due to their strength and chemical stability. A bull nose gun may be used to secure the containment sleeve to the seismic foundation framer.

An exemplary containment sleeve is secured to a plurality of seismic foundation framers to produce a sleeved containment form that can receive and contain a wide variety of concrete mixes. The mix may flow into the sleeved form and through the frames and around the rebar and structural pins to form a structurally reinforced concrete member. An exemplary containment sleeve comprises sleeve apertures that allow concrete to penetrate therethrough to attach the containment sleeve to the concrete. The sleeve apertures may be sized to allow the concrete to bulge therethrough but not flow out of the apertures. In this way, the concrete and sleeve are attached, wherein concrete extends through the sleeve apertures. The size of the sleeve aperture may be specifically selected to provide attachment to the concrete mixture wherein a more viscous concrete mixture may accommodate larger sleeve apertures and a less viscous concrete mixture may require smaller sleeve apertures. In addition, the size and the density of sleeve apertures may be selected to allow the proper permeation for curing the concrete.

An exemplary containment sleeve comprises two or more layers and these two or more layers may each have apertures therethrough. The apertures may be offset to prevent cementitious material from seeping out from the containment sleeve. In an exemplary embodiment, the apertures are offset and the cementitious material extends through apertures in a first layer but is then blocked by the second layer of the containment sleeve. The containment sleeve may be a woven or non-woven material or sheet that comprises strands of material. An exemplary containment sleeve may be a woven material having a weave pattern and venting apertures between the strands or yarns. An exemplary containment sleeve may be a non-woven material, such as a spunbonded polymeric material, such as polypropylene. The strands of the containment sleeve may be yarns that comprise a plurality of fibers or filaments. The cementitious material may extend around strands of the first layer to secure the containment sleeve to the cementitious material. The first and second layers may be made out of the same material but may have different weights, weaves and aperture sized, shapes and density. Alternatively, the first and second layers are made out of different materials. The cementitious material may extrude through apertures in the fit layer or inside layer to be retained by the second or outside layer. Cementitious material may also be configured in between the layers.

An exemplary containment sleeve comprises strands, which may be made up of yarns, fibers, filaments, or strips of material, and openings. Depending upon the application, the width of each strand preferably ranges between about 1 mm to about 4 mm wide, more preferably ranges between about 1.5 mm to about 3.5 mm wide. The thickness of layer of material, inside or outside layers, that may used in a containment sleeve, may be in the range of between about 0.01 mm to about 0.20 mm, more preferably ranging between about 0.02 mm to about 0.06 mm or as needed, depending upon the application.

An exemplary containment sleeve may comprise a translucent window for viewing the cementitious material or the components of the foundation, such as the seismic foundation framer or rebar and the like. The cementitious material may have color change properties and a window may allow determination of a curing state of the cementitious material.

The spacing or distance between the strands of the containment sleeve, that produce the desired venting apertures spacings may range from between about 0 mm to 5 mm, preferably ranging between about 0.25 mm and 3 mm, most preferably ranging between about 0.25 mm to 1 mm, or may be pre-engineered and spaced as necessary, preferably manufactured from polypropylene or bio-plastics H2O, CO2, or basalt, as needed to suit a particular mix and or application. Note the viewing window can range in width and length as needed depending upon application The size, shape and density of apertures in the containment sleeve may be controlled to provide the required permeation for a given application, including the type of cementitious material and the environmental conditions. In addition, the shape of the sleeve aperture may be selected to provide good interface characteristics with the concrete extending therethrough and may be circular, oval, polygonal, elongated, such as slits, or cross-slits in the sleeve material.

An exemplary containment sleeve may also comprise printed material thereon, such as logos, trademarks, embedded chips, dimensional features and the like. A builder or manufacturer may desire to have their company name or logo on the sleeve material as this will be visible during construction. In addition, a sleeve may have dimension features, such as a scale or scale lines to allow for proper measurement and cutting of the sleeve material before or during installation, or for general measurement of a building structure, such as a sleeved form that utilizes a dimensionally marked sleeve. A containment sleeve may have marking to indicate distances, such a lengths or heights. A containment sleeve may have marking to indicate location(s) such as plumbing, electrical, stairs, fireplaces, panels (electrical junction boxes), windows, joints/seams, corners, doorways, columns, etc. As an option the external containment sleeve's surfaces may encompass surface impressions such as embossed patterns and or colors and/or logos on the external containment sleeves An exemplary sleeve enables construction in a wide range of environmental conditions, much wider than conventional foundation methods, wherein the concrete is exposed directly to the ambient air. Foundations and other structures can be formed in wet and muddy conditions, including sand, or even during rain or under water, as the sleeve will protect the concrete from the elements and keep excessive water from compromising the concrete mixture. In addition, foundations and other structures may be formed in hot and dry conditions, wherein the sleeve regulates the rate of evaporation from the concrete and ensures an optimized cure rate as needed.

The current invention resolves many of the prior art concrete construction limitations by employing the innovative use of a seismic foundation framers attached to an external reinforced containment sleeve as disclosed herein.

The current invention significantly expands the performance quality and significantly expands the range of castable cementitious mixes and other materials over the prior art, further including their associated admixtures and aggregates, etc. In several specified embodiments encompasses that the current invention light weight quickly assembled external containment sleeve promotes faster casting rates and thus shorter construction schedules onsite over the prior art, thus reducing construction timelines at a reduced cost. The seismic foundation framer having external reinforcement fabric serves as a versatile light weight flexible reinforcing leave-in-place cast-in-place improved cementitious structural containment form(s), significantly improving a wide variety of reinforced concrete construction processes such as speed, accuracy, expands the structural "foundation" size ranges, and improves construction speed and diversity.

The containment sleeve may specifically designed for preferred curing environment, for optimized casting speeds and optimize the curing characteristics for a wide variety of cementitious (concrete) mixes such as, but not limited to, predictably obtain a higher percentage of the performance potential such as compressive strength, tensile strength durability, wall effect, grain boundary, impermeability, sheer strength, porosity control, oxidation resistance, erosion control, air and or argon, nitrogen entrainment, tension resistance, over the prior art and simultaneously provides fast casting on the construction site further includes high performance complex mixes such as having improved ductility, freeze thaw resistance, stress displacement, alkali resistance, and reducing porosity. The external containment sleeve predictably improves the casting outcomes of virtually all concrete mixes from generic concrete mixes to advanced highly complex high performance and ultra-high performance cement mixes, such as humidity regulating and memory return, air purifying cementitious mixes that previously required complex casting processes previously obtainable only in a controlled factory environment.

Employing the inventive vent regulating and containment sleeve as an apparatus encourages and promotes realizing a higher percentage of the mixes potential strength and other significant characteristics by controlling the mix's water percolation and uniformity to optimize the mix's curing rate (to control autogenous shrinking) and simultaneously improves the reinforced foundation dimensional accuracy and stability, i.e. "drying shrinkage". This is particularly beneficial and advantageous when casting specialized (cementitious mix proportions), such as but not limited to obtaining an early high shear strength, and to obtain high toughness and high durability to onsite exposure conditions for, reducing construction timelines.

In an exemplary embodiment, a containment sleeve is used to control the degree of casting porosity, i.e. including controlling venting communication between the interior of the cast containment "sleeve(s)" to the external atmosphere, for controlling the specific mix or mixes' optimized curing characteristics as disclosed herein.

An exemplary containment sleeve may have yarns with a denier ranging between about 50 to 1200 denier, more preferably ranging between about 100 to 800 denier, most preferably ranging between about 350 to 700 denier preferably for casting foundations having dimensions up to about 10 inches, 25.4 cm, high by 14 inches, 35.56 cm wide or as needed depending upon the application. Polypropylene and basalt woven fabric reinforcement materials are most preferred.

The containment sleeve may have dimensions larger than about 10 inches, 25.4 cm high by 14 inches, 35.56 cm wide up to about 30 inches, 76.2 cm high by 30 inches, 76.2 cm wide or as needed depending upon the application, preferably ranging between about 1,100 to 4,000 denier, more preferably ranging between about 1,200 to 2,500 denier, most preferably ranging between about 1,500 to 2,000 denier for larger onsite casting foundations and beams, such as multi-frame foundation. Polypropylene and basalt woven fabric reinforcement materials are most preferred.

An exemplary containment sleeve may be configured to provide a controlled curing rate for high strength cementitious materials, such as super high cementitious materials having a strength of 60 kpsi and higher. These super high cementitious materials can only be formed when the rate of curing is controlled.

An exemplary containment sleeve can be used to quickly cast a wide variety of simple to highly complex mixes on site having narrower tolerance that previously only be able to be cast in a specialized factory environment having specific temperature and humidity controls. As an option, the current invention encompasses casting in an atmospherically controlled factory environment then transporting and assembling onsite.

The containment "sleeve's" materials and characteristics may vary at any location or section as needed such as having novel means for receiving settable mix materials, the external containment sleeves having accurate retaining means, the containment sleeve optionally having engaging folded sections or strips or other facings, with optional waterproofing means; e.g., coverings, coating, or foils, to provide a wider range of onsite casting environments and further having material characteristics that lowers manufacturing and shipping cost and improves diversity, predictability, accuracy, reliability, and improved speed over the prior art for improved control of onsite casting in real time containing a wide variety of cementitious materials such as but not limited to; constructing foundations, box beams, reinforcing ring foundations, tension rings, ringwalls, footings, slabs, walls and roofs is concerned, more particularly, provides previously unavailable structurally improved reinforced foundations and other reinforced concrete structures onsite in real time that is smaller, lightweight while at the same time offering pronounced rigidity or stiffness for construction implementation in fast, accurate reinforced concrete casting and material construction techniques.

The current invention further provides the ability to cast multiple grades of concrete sequentially, and accept a wide variety of viscosities and casting mixes.

The previously unavailable combination of the sleeve and seismic foundation framer creates an inexpensive box beam.

The current invention further significantly improves the speed, quality, and size of each structural reinforced foundations or sections over the prior art and simultaneously eliminates cementitious and non-cementitious materials leakage, and improves conformational tolerances, and improves related issues to designing workable concrete mixes and may be used for both new construction and rehabilitation, such as retrofitting and refurbishing a wide variety of structures, further including repairing foundations and or sections of foundations.

The current invention furthermore encompasses the seismic foundation framer providing improved resistance to soil subsidence, movement of the soil.

The containment sleeves provide accurate pre-engineered regulation and control of grout and/or mortar venting in between the containment sleeve's pre-engineered venting apertures (filament spacing) for accurately regulating the cementitious and or non-cementitious mixes overflow between the venting filaments (apertures). The containment sleeve provides a pre-engineered grout shield that regulates and controls grout and or mortar venting in between the spaced filaments (apertures) by regulating the amount of mix external venting characteristics in between the "sleeve's" (apertures) venting voids or spacing of the reinforcing filaments as needed.

Various cementitious masses serve various functions, and can be mass-constructed onsite in real time having fabric reinforced foundation products having improved structurally reinforcing concrete containment sleeve packaging methods.

The reinforced external containment sleeve of the current invention provides the ability to employ a wider variety of construction materials onsite in real time, such as cementitious materials, concretes, foams, plasters, insulations, stuccos, may be employed that was previously unavailable nor cost effectively constructed.

This innovation better adapts their full architectural scale designs to the realities of actual onsite concrete construction. Note that low concrete strength test results common in casting in hot weather are often caused by poor mix protection and fast initial curing of test specimens. Specifically tailored to general mix(es) as for example, for obtaining a high initial shear strength suitable for high speed casting by providing the minimal pre-engineered curing time between each casting layer, depending upon application.

The containment sleeve may employ multiple mesh layers, an inside layer and an outside layer, that are suitably positioned and bonded together depending upon application. Two sleeve layers are preferred, multi-layered sleeves are most preferred, and are preferably bonded having a 90 degree crossing angle providing improved cement to sleeve bonding characteristics. A multilayered containment sleeves may be designed with apertures that are not aligned and wherein apertures of a inside sleeve layer are not aligned with the apertures of the outside sleeve layer.

The current invention's external reinforced containment sleeve optionally accommodates improved moist curing water, fogger, applications eliminating surface erosion not limited to the top of the form as in the prior art, to predictably produce early structural loading and eliminates the necessity to structurally over-design having improved cost economy due to faster onsite construction speeds, such as from wind driven rain, and repels bulk water penetration (wicking of moisture).

In other exemplary embodiments encompasses employing a sleeve as an apparatus that significantly expands the casting mass and volume, as for example when casting; note that within the prior art is currently limited to casting high performance mixes up to about 50 cm thick (about 20 inches) and requires the immediate covering of the cast component such as with plastic sheeting material to prevent the rapid water loss to obtain or realize the potential casting characteristics for sustainable durability and to obtain maximum potential strengths.

Additionally, some cementitious casting materials specifications may not potentially be realized or obtained, such as without employing the current invention's methods and apparatuses including specifically pre-engineering the external containment sleeve curing characteristics.

The external fabric reinforced containment sleeves improves the mixes performance characteristics and structural performances such as but not limited to: 1) mixture proportioning; 2) mechanical properties; 3) time-dependent deformations; 4) flexural and shear behavior; 5) bonding behavior; 6) pre-stress losses; 7) the structural behavior of full architectural scale elements; 8) Improves the grain boundary; 9) Improves electrophysical bonding characteristics; 10) Improves electrochemical bonding characteristics, additionally the venting apertures may also be specifiable by design as needed.

Furthermore, the inventive external containment sleeves optimize a wide variety of concrete additives, including optimizing a wide variety of admixtures characteristics for improving and optimizing cement interface and expansion coefficients, such as self-consolidating (shrinkage-compensating) concrete. Additionally, the containment sleeve and the mix venting apertures regulate the slump control and produce less shrinkage.

The containment "form" may be used as a bulkhead form, and being lighter than plywood or steel forms, is easier, faster and more accurate to assemble onsite and cast in place, and requires no special formulations of concrete mix is necessary. The preferred mix slump ranges from about 0" to 2.5", a slump of up to about 3" may be used with proper precautions. The most preferred casting slump ranges between about 0.0" to 1.5".

The current invention's frames and secured containment "sleeves" significantly expands the castable range of the concrete mix castable sections and cost less.

The current invention thus provides a variety of additional seismic upgrade characteristics by improving reinforcement and the concrete mixes' highly complex stress transfer characteristics, such as when constructing highly durable structures that may encounter tsunami, hurricanes, typhoons, tornadoes, earth quakes, mudslides, flooding.

The current invention encompasses that the constructed structures in some configurations may be subsequently flooded, dug out, and re-occupied.

In several specified embodiments encompasses that the current invention's reinforced containment sleeve(s) are more cost effective and ecological, leaving a smaller "carbon footcast" than the concrete construction systems of the prior art.

The inventive combination of containment sleeve and seismic foundation framer provides more accurate calculations of the mixes volume, improving conformational tolerances and simplifying inventory. The containment sleeves and the frames provide the simultaneous and or sequential casting of multiple mixes, or different grades of mixes. The frames and the containment sleeve system is compatible with a wide variety of micro-reinforcements providing structural improvements for using fiber-reinforced concrete (FRC) mixes to improve a wide variety of concrete performance characteristics such as improved stiffness and reducing deflection.

The inventive combination of containment sleeve and seismic foundation framer provides the ability to cast micro-reinforced concretes such as but not limited to basalt reinforcements such as rovings, ropes, filaments, twills, microfibers, woven yarns, carbon nanotubes (including their variations), and or graphene in a wide variety of reinforcing geometries such as in the form of tubes, nano-tubes, hollow tubes, stars, etc. When employing micro-reinforcements, concrete, instead of being a protection shell for the reinforcement, now becomes a protective and integrative structural component, combined with a wide variety of reinforcement(s).

The fiber-reinforced concrete increases structural stiffness and reduces deflection of casted concrete members as well as decreasing the stress in the reinforcement(s). This is particularly significant in thin cast reinforced concrete sections and other reinforced cementitious members, where the structures geometry and profile significantly contribute to controlling complex deflection characteristics. Such as curvilinear structures.

The external containment sleeves and seismic foundation framer improves the accuracy of reinforcement (rebar) placement and securement such as but not limited to the placement accuracy of plumbing, piping, conduit, electrical, earth tubes, fiber optics, fiber bundles, a variety of filament windings, and other improvements of mechanical properties, if necessary or required. Note conventionally the weakest point of a prior art foundation is its surfaces. Note that by employing the current invention external foundation surface is now the foundation's strongest area.

In an exemplary embodiment, adhesive or a cementitious material may be applied to the top of the foundation for attachment of an above structure. As an option adhesive or bonding encompass the spraying of a variety of cementitious adhesive materials in between the cast foundation having interlocking layers (cold joints) to provide an improved interlocking bond and provides additional reinforcement and strengthening to the interlocking surface bonding characteristics, improving an interlocking key-way interface and reduces water moisture penetration and long-term corrosion.

The containment sleeve further provides an improved bonding surface for additional inside and outside materials that may be applied to cast "foundations" as necessary to flow through the venting spacings in containment forms, such as but not limited to providing a suitable bonding surface for plasters, stuccos, clays/mud, tiles, stones, etc. as needed, and furthermore significantly reduces or eliminates cold joint interface limitations as needed in the art.

The combination of the synergistic containment sleeves and frames are compatible with a wide variety of man-made and indigenous aggregates, such as but not limited to crushed coral, pumice, scoria, stucco, plaster, clay (including local indigenous clays), etc., and are further encompasses a wide variety of recycled construction waste, recycled concrete (urbanite), glass, fibers, steel, and a wide variety of additives and admixtures, etc., as needed in the art and virtually any cementitious mix admixtures, aggregates, and additives including advanced reinforcements, such as micro-reinforcements, including carbon nanotubes.

An exemplary containment sleeve may comprise markings, such as dimensional markings to allow measurement of the amount used, and/or a general measure of a length used in construction. Marking may also include advertisements, company names and/or logos, and the like. In addition, a QR codes may be printed on the containment sleeve and may provide information about the containment sleeve and/or the construction project.

The containment sleeves am preferably dispensed from removably attached spools or dispensing rolls.

As an option or a variation of the current invention, the ends of the external sleeve may be tapered to fit (interlock) together as needed (not shown), such as overlapping the cast corners (interlocking) the cast layers.

An exemplary containment sleeves optionally may incorporate color changing dyes thus indicating the cementitious mix critical curing/casting temperatures and the curing rate in real time from the sleeves containing color changing materials, such as color changing from a hot red to a cooler green color depending upon the mix for accurately indicating the critical cast mix temperature in real time to optimize the mix's curing rate and uniformity (more uniform heat dissipation).

The external reinforced containment sleeves of the current invention encompass simplifying and verifying the onsite mix casting quality visual inspection process (i.e. viewing through the translucent sleeve). As an option the entire sleeve can serve as a see-through window, monitoring/metering window.

The containment sleeves accept a variety of in depth cementitious pigments (color/dyes). The external containment sleeve prevents unsightly concrete staining and discoloration. The external containment sleeve helps maintain a uniform edge and improves the aesthetic appearance of the concrete finish, and the external containment sleeve reduces or eliminates random surface cracking and edge curling cause by the concrete mix's normal volume change and significantly limits or eliminates the range of crack occurrence in general within the set area.

The external reinforced containment sleeve method and apparatus encompasses a wide variety of suitable fabric reinforcing materials, such as basalt, polypropylene, and other fabric reinforcing materials, having suitable configurations such as but not limited to, herringbone, cross-weave, plain twill, basket, satin, leno, mock leno, further including multidirectional weaves, unidirectional weave, or as needed.

An exemplary containment sleeve may be woven, or a non-woven and may have fibers or yarns orientation that are multiaxial or random. Fibers types are categorized by the orientation of the fibers used, and by the various assembly methods used to accurately position and hold the fibers together.

The external containment sleeves may optionally have gusseted sides (edges) composed of four sides of the same or different materials (composition) such as, foils, reflective materials, filaments, filament windings, fiber orientations and fabrics, fiber bundles, scaled venting apertures having different sizes and spacing's, crossing angles, weaves and patterns, such as the diameter(s) of the filaments and the weaves or pattern, as specifically needed, and a wide variety of other improved mechanical properties to optimize the curing environment each having their own uniquely tailored characteristics as needed depending upon the mix and application. As an option the current invention may employ pre-pleated or gusseted multi-sided external containment "sleeves."

As an option the current invention may encompasses an anti-counterfeiting indicating component such as embedding fluorescent dyes that fluoresce, such as revealing coils, labels, etc. from the exposure from ultra-violet light or as an option may encompasses viewing window or port to visually reveals the "hoops," "coils," such as but not limited to logos, holograms, bar codes, embedded chips, factory codes, inventory codes, manufacturing codes etc.

The fabric reinforced external containment sleeve is preferably composed of woven basalt materials including composite basalt materials, such as basalt fibers, many possible combinations of fibers materials, resins, its variations such as but not limited to fiber reinforced or fiber bundles and filament windings preferably having basalt fabric and or resin systems, further including solid core and or hollow core basalt reinforcement, basalt microfibers and filaments reinforced composite basalt provides sustainability and weight savings within the inventive reinforced concrete structure. Additionally, basalt reinforcement(s) have lower shipping costs due to the lightweight nature of the material. A containment sleeve made from basalt permits cementitious mixes that heat up to about 150 degrees C. while curing and has the advantage of increase surface area of contact for the surrounding cementitious materials. Basalt containment sleeve are easier and faster to handle and install, significantly reduces or eliminates long-term reinforcement degradation and expensive long-term repair and maintenance (replacement costs).

High temperature composite basalt rebar reinforcement having coefficient of thermal expansion (CTE) is very close to that of most cementitious mixes and provides improved tensile strengths that is twice that of steel reinforcement(s) and having improved mechanical strength pins, thermal stability, having significantly higher corrosion resistance and is compatible with a wide variety of additives, aggregates, admixtures, resins, and epoxies while simultaneously providing an electromagnetic insulator particularly solid composite basalt or advanced hollow basalt bars further including basalt, meshes, ropes.

An exemplary containment sleeve may be folded over the top of the seismic foundation framer about an inch, and or folded over and touching, and or folded over and overlapping, or as needed depending upon the application (partial folding over and complete folding over).

An exemplary containment sleeve may surround or encapsulate two or more modular cementitious supporting forms or framer assemblies comprising two or more seismic foundation framers. The exemplary containment sleeve may be cut or pierced for inserting rebar or other joining component through the sleeve for coupling of assemblies or seismic foundation framers.

Construction Types

The foundation framer system may be employed for construction of a variety of above grade and or below grade foundations. The foundation framer system and cementitious supporting form may be a below grade foundation for a building, such as a dwelling, place of business or manufacturing facility, for example. The foundation framer system and cementitious supporting form may be used a wide variety of above structures such as but not limited to air form structures. 3 printed structures, conventional structures, walls (brick, block, stone), further including water tanks, reservoirs, small dams, stairs, etc. The attachment and or securement points may be used to attach the foundation to the foundation framers, sleeve, and or any combination therein.

The foundation framer system having a defined dimensional aspects may enable narrower or smaller excavation setbacks on a construction site than conventional foundation required supported forms to be installed before the cementitious material is poured.

As an example, the external containment sleeve (construction apparatus) having reinforcement may be pre-engineered by the described inventive measures of the current invention herein there is not or only a little further manufacturing is needed for optional removable attachments of foundations to above ground structures, such as but not limited to pneumatic (air form) having securement components may be necessary to attach or insert to the cast structure if needed such as but not limited to attaching "hoops" "loops", eyelets, grommets, screw pile bolts, adjustable straps, flaps, pads, tabs such as, but not limited to, openings for cementitious filling or injection and or valves and valve connections, to cut edges, to fasten adjustable straps and latches, such as for permanently and or temporarily positioning the air form above the ring foundation having accurate positioning and adjustable securement onsite as needed further including the air form securement straps and fittings may be attached to the sleeve, may be attached to the frame, and is preferably attached (secured) to both sleeve and frame, or as needed.

An exemplary cementitious supporting form may be a foundation that is be manufactured offsite and transported onsite and assembled onsite.

An exemplary cementitious supporting form may be a foundation for emergency and/or temporary structures as it can be produced in a very short time. The structure may be temporary and removed from the foundation made with the cementitious supporting form. The cementitious supporting form may also be made offsite and used in a temporary location, such as for an emergency structure.

An exemplary cementitious supporting form is compatible with porting of the foundation. As an example, cutting through sleeve and slide in porting material (PVC, conduits, piping, etc.) and then attach (secure) the porting tube with a wire tie to the frame, attach to the sleeve, or any combination therein while the cast cures.

The reinforced external containment sleeve and framer of the current invention encompasses more complex stress transfer characteristics, and automatically self-conforms (self-compensates) to a wide range of ground conditions; i.e. contours, ground irregularities, soil subsidence, etc., further having the option of a leveling screw.

An exemplary containment sleeve may have attachments for the attachment to other structures such as an air form. These attachments, such as hoops" "loops", eyelets, grommets, screw pile bolts, adjustable straps, flaps, pads, tabs, may be configured on the containment sleeve or attached to the containment sleeve. An attachment may extend through the containment sleeve and may be supported by the cementitious material or by a frame or other component within the sleeve. An attachment may be use to connect to another structure, such as a structure above the foundation such as, but not limited to, pneumatic (air form) having securement components that may be necessary to removably attach or insert to the cast structure if needed such as but not limited to attaching "hoops" "loops", eyelets, grommets, screw pile bolts, adjustable straps, flaps, pads, tabs (not shown), such as, but not limited to, openings for cementitious filling or injection and or valves and valve connections, to cut edges, to fasten adjustable straps and latches, such as for permanently and or temporarily positioning the air form above the ring foundation having accurate positioning and adjustable securement onsite as needed, further including the airform securement straps and adjustable fittings may be optionally attached to the containment sleeve, may be optionally attached to the seismic frame, and is preferably attached (secured) to both containment sleeve and seismic frame, or as needed.

An exemplary seismic foundation framer can be used as a lintel. A lintel is a structural horizontal block that spans the space or opening between two vertical supports. It is often found over portals, doors, windows and fireplaces. Modern day lintels are made using prestressed concrete and are also referred to as beams in beam and block slabs or ribs in rib and block slabs.

The containment sleeve may comprise strands of highly oriented fibers that are oriented along the length of the strand or yarn. This high level of orientation increases the tensile strength and durability of the containment sleeve. Examples of highly oriented material are Spectra, available from Honeywell International, or Dyneema, from DSM Dyneema B.V.

A full architectural scale 3-dimensional seismic framer reinforced foundation/footing casting method and apparatus according to any claim or embodiment disclosed herein, having external reinforcing cementitious containment "sleeves" ensuring the mix test specimens are properly cured to better adapt their designs to the realities of actual field construction.

A containment sleeve may be a full architectural scale flexible external fabric reinforced cementitious containment sleeves and may by hydrophobic and repel bulk water penetration on contact, including wind driven rain, snow etc., by directing it away from the external reinforced cementitious sleeves' exterior surfaces.

A foundation formed from a cementitious supporting form as described herein, being tailored (customized) for highly complex cementitious casting characteristics to realize a higher percentage of the cementitious concrete mix potential performance characteristics including microstructure properties and materials improving a generalized quality assurance including optimizing, strengthening, protection, proportions, production, and delivery on the construction site, that previously has required casting in an atmospherically controlled factory environment, particularly when casting high performance and specialty concrete mixes.

A containment sleeve may be a full architectural scale flexible external reinforced cementitious containment sleeve having external reinforced gusseted side surfaces composed of different materials, filaments, filament windings, fiber orientation and fabrics, fiber bundles, sizes, apertures (spacings), each external reinforced cementitious sleeves that is flexible and having their own uniquely tailored characteristics as needed depending upon the reinforced foundation/footing casting application.

A containment sleeve may be a full architectural scale external fabric reinforced cementitious containment sleeve having a pre-engineered external venting and regulating apertures that permits improved reinforced cementitious foundation/footing casting characteristics for a variety of highly complex reinforced cementitious mixes such as memory return, air purifying (smog absorbing), self-consolidating concrete, and or humidity regulating cement mixes.

A containment sleeve may be a may accept a variety of in depth pigments (color dyes).

A containment sleeve may be a cement molding and casting sleeve for any concrete construction purposes with or without a cementitious supporting form or seismic foundation framer as described herein. A containment sleeve as described herein, may improve any cementitious, concrete process, making it faster, simpler, and more adaptable on the construction site in real time during any point in the reinforced concrete construction process.

A containment sleeve as described herein may be joined or bonded together or to any other portion of a cementitious supporting form, or other component on the work-site by a sleeve adhesive, a fastener, by heat sealing, cold sealing or ultrasonic welding.

A full architectural scale automated 3-dimensional foundation/footing casting external reinforcing containment mesh formwork element that is flexible method and apparatus according to any claim, wherein the mesh regions are defined by pre-engineered venting apertures of a specific size and spacings of the externally reinforced mesh foundation structure.

The full architectural scale automated 3-dimensional flexible external reinforcing containment sleeve foundation/footing casting method and apparatus according to any claim or embodiments herein, comprising providing a base reinforcing surface through which the mix material can selectively partially penetrate (forming a cementitious bonding surface), the reinforcing base surface for encapsulating the cast foundation/footing.

The full architectural scale method and apparatus of any claim encompasses that the cast in place leave in place external containment sleeve(s) are more cost effective and ecological, leaving a smaller "carbon footprint", as for example the containment sleeve(s) may be specifically tailored to promote reducing thermal shock and provides a higher insulation per mass to volumes ratio reducing alkali-silica expansion, thermal cracking, and improving resistance to sulfate attack, and eliminating excessive water reduction and improving external water penetration resistance and improving durability and the cementitious mix's compatibility and long term sustainability.

As set forth in any claim, wherein enclosing the ends of the canst external flexible containment sleeve comprises attaching an adhesive glue or tape, tie-wire, staple, zip-tie, stitch, onto the containment sleeve.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
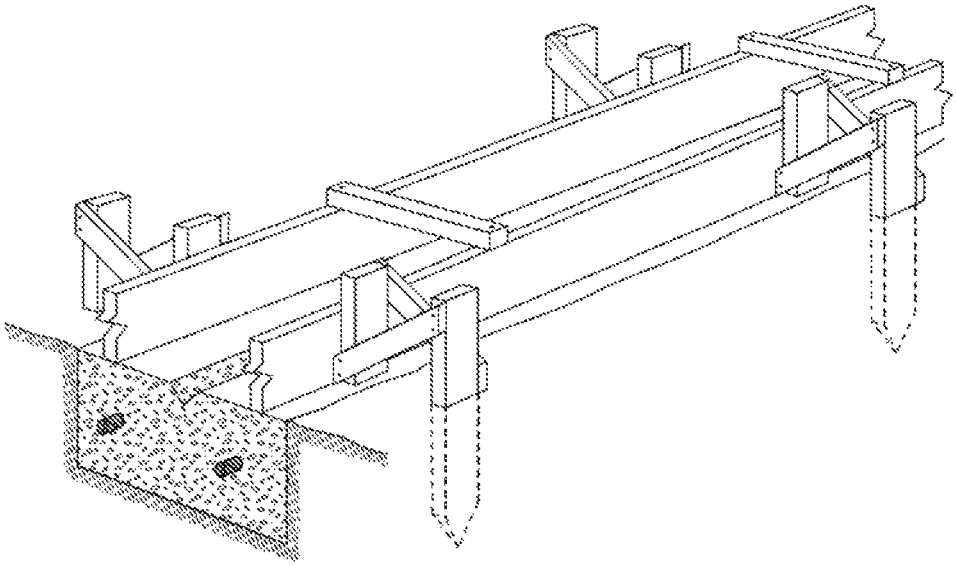
FIG. 1 PRIOR ART
FIG. 1. illustrates a conventional prior art generally rectilinear temporary wooden (supported by a 2×8) below grade foundation/footing with a keyway and two reinforcement bars.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

The term 'Retainer' as used herein is defined as a thing that holds something in place.

The term 'die' as used herein is defined as a. to impress, shape, or cut with a die.
b. any of various devices for cutting or forming material in a press or a stamping or forging machine.
c. a hollow device of steel, often composed of several pieces to be fitted into a stock, for cutting the threads of bolts or the like.
d. one of the separate pieces of such a device.
e. a steel block or plate with small conical holes through which wire, plastic rods, etc., are drawn.

The term 'Modular' or 'modular construction' as used herein is defined as 1: of, relating to, or based on a module or a modular 2: constructed with standardized units or dimensions for flexibility and variety in use modular furniture 3: made from a set of separate parts that can be joined together to form a larger object: 3: Construction in which similar units or subcomponents are combined repeatedly to create a total system; 4. A construction system in which large prefabricated units are combined to create a finished structure. 5. A structural design which uses dimensions consistent with those of the uncut materials supplied. Common modular measurements are 4 inches (10.16 cm) to 4 feet (1.2 m).

The term 'universal coupling' 'universal mount' is defined as a form of coupling between two rotating shafts allowing freedom of angular movement in all directions.

The term "venting aperture" as used herein is a series of pre-engineered gaps or openings that regulates the desired cementitious mix quantity or rate of water evaporation, thermal transmission to accurately control the cementitious mix curing pre-engineered quality or rate of the cementitious mix and is defined by filament spacings, diameters, shapes, and configurations and encompasses pre-engineered venting apertures such as but not limited to square, rectangular or any combination therein.

The term "fabric" as used herein is defined in polymeric terms as a manufactured assembly of long fibers of carbons, aramid or glass, plastics, basalts or any combination of these, to produce a flat sheet of one or more layers of woven fibers such as filament windings. The woven fibers are arranged into some form of sheet, known as a fabric, to provide ease of onsite handling. Different ways for assembling woven fibers into sheets and the variety of fiber orientations possible lead to there being many different types of woven fabrics, each of which has its own mechanical characteristics.

The term "mesh" as used herein is defined as mesh is an open mesh, netting, web, webbing, used for reinforced containment sleeves and internal reinforcement to improve concrete stress transfer and displacement.

The terms "sleeve, sleeves, external sleeve, containment sleeves, or sleeve containment form", as used herein, is an apparatus defined as a flexible leave-in-place cast-in-place external reinforcement and moldable containment form(s) tailored to specifically regulate the cementitious materials curing environment. The inventive external fabric reinforced containment sleeve of the current invention has pre-engineered venting apertures that functions as a highly selective transport membrane for a predictably controlling and regulating the encapsulated cementitious mixes evaporation rate and thermal exchange transmissions to the external environment etc. as needed.

The term "concrete" as used herein is a composite material composed of coarse granular material (the aggregate or filler such as sand, conglomerate gravel, pebbles, broken stone, or slag) embedded in a hard matrix of material (the cement or binder) that fills the space among the aggregate particles and glues them together. Concrete, as used herein, refers to a cementitious mixture that cures to form a rigid body.

The term cement or cementitious, as used herein, refers to cementitious mixtures including compounds that cure over time to hold aggregate or concrete in place. These materials include traditional Portland cement and other cementitious materials, such as fly ash, ground granulated blast furnace slag (GGBS), limestone fines and silica fume. These materials are either combined at the cement works (to produce a composite cement) or at the concrete mixer when the concrete is being produced (the cementitious product is called a combination in this case). Fly ash and GGBS are the most commonly used of these materials in the UK. These secondary materials are useful by-products of other industrial processes, which would potentially otherwise be sent to landfill. Using GGBS or fly ash in concrete, either as a mixer addition or through a factory made cement, significantly reduces the overall greenhouse gas emissions associated with the production of concrete For purposes of this specification it will clearly be understood that the word(s) "option" "optional" or "optionally' mean the subsequently described event of circumstances may or may not occur, and that the description includes instances where said event or circumstance occurs and instances in which it does not.

Rebar, as used herein, is an elongated support that may be circular in cross-sectional shape, such as a rod. Rebar may be metal, polypropylene, basalt or composite materials.

As shown in FIG. 1, a conventional generally rectilinear temporary wooden below grade foundation/footing has a keyway and two reinforcement bars. A conventional cementitious supporting form has structures that are formed in place to create barriers for concrete that are typically removed after use. These forms are typically made of wood and require braces in many cases to resist the load and forces of the concrete when poured. These forms are time consuming to construct and break down and require additional materials that must be transported to and from the work-site.

Figure 2:
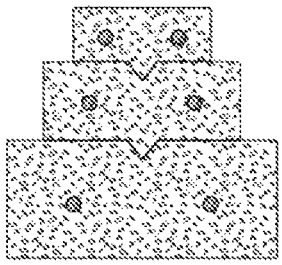
FIG. 2 illustrates a conventional three tier foundation/footing with three cast sections (step cast) having one below grade foundation/footing and two additional layers above grade with three interlocking keyways

As shown in FIG. 2, a conventional three tier foundation/footing has three cast sections (step cast) having one below grade foundation/footing and two additional layers above grade with three interlocking keyways.

Figure 3:
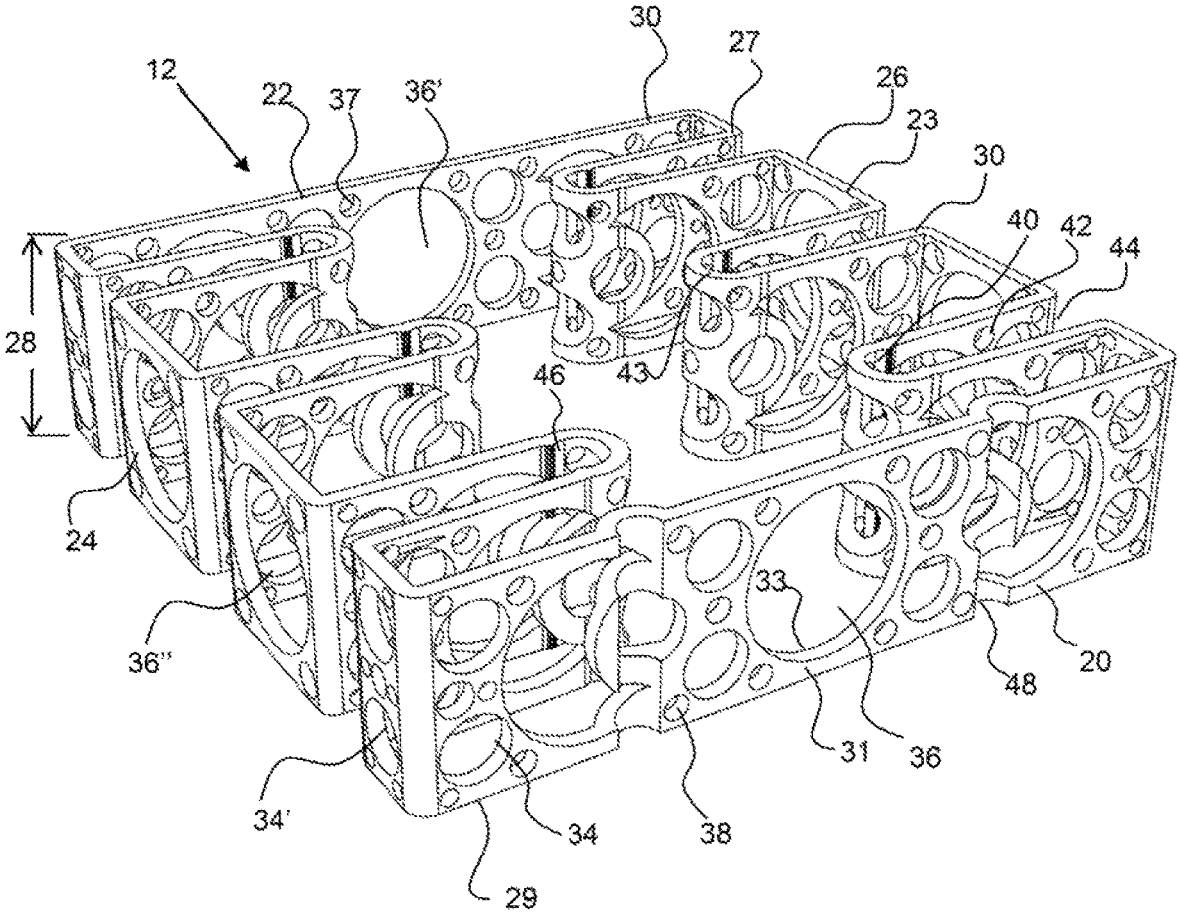
FIG. 3 is a perspective view of an exemplary seismic foundation framer that is a continuous ribbon having a plurality of attachment points, a plurality of structural pin openings, a plurality of rebar openings and a plurality of rebar retainers.

As shown in FIG. 3, an exemplary seismic foundation framer 12 has a plurality of rebar receiving retainers 40 extending in from the sides of the frame and a plurality of both pin openings 36 and rebar openings 34 through the frame. The frame may comprise threaded openings 37 that are threaded to allow components to be secured directly to the frame by turning them into the threaded opening such as seismic stirrups. The exemplary frame has a perimeter 23 formed by a ribbon 30 having a depth 28 from a front surface 27 to a back surface 29 and a thickness from an outside surface 31 to an inside surface 33. The exemplary frame has a height from a bottom 22 to a top 20, a width from a first side 24 to a second side 26. The ribbon may extend completely around the perimeter to form a continuous loop, providing some additional structural integrity to the frame. The frame is generally rectangular shaped having a rectangular shaped outer perimeter. The exemplary frame is free standing, wherein the frame can be placed on the bottom and stand upright without support.

The ribbon forms a plurality of rebar retainers 40 for retaining rebar to the seismic foundation framer. The rebar retainers comprise rebar receiving and retaining channel 42 that extends in from the outer perimeter 23 of the seismic foundation framer 12. The ribbon turns in from the perimeter forming a rebar channel opening 33. Rebar can be slid along the channel and then forced past a retaining protrusion 46 or protrusions that extend from the outside surface 31 of the ribbon 30 along the rebar channel 42. The rebar is then accurately retained in the rebar retainer 40 such as between the retaining protrusions and the channel loop 43, wherein the ribbon loops at the extended end of the channel.

Figure 4:
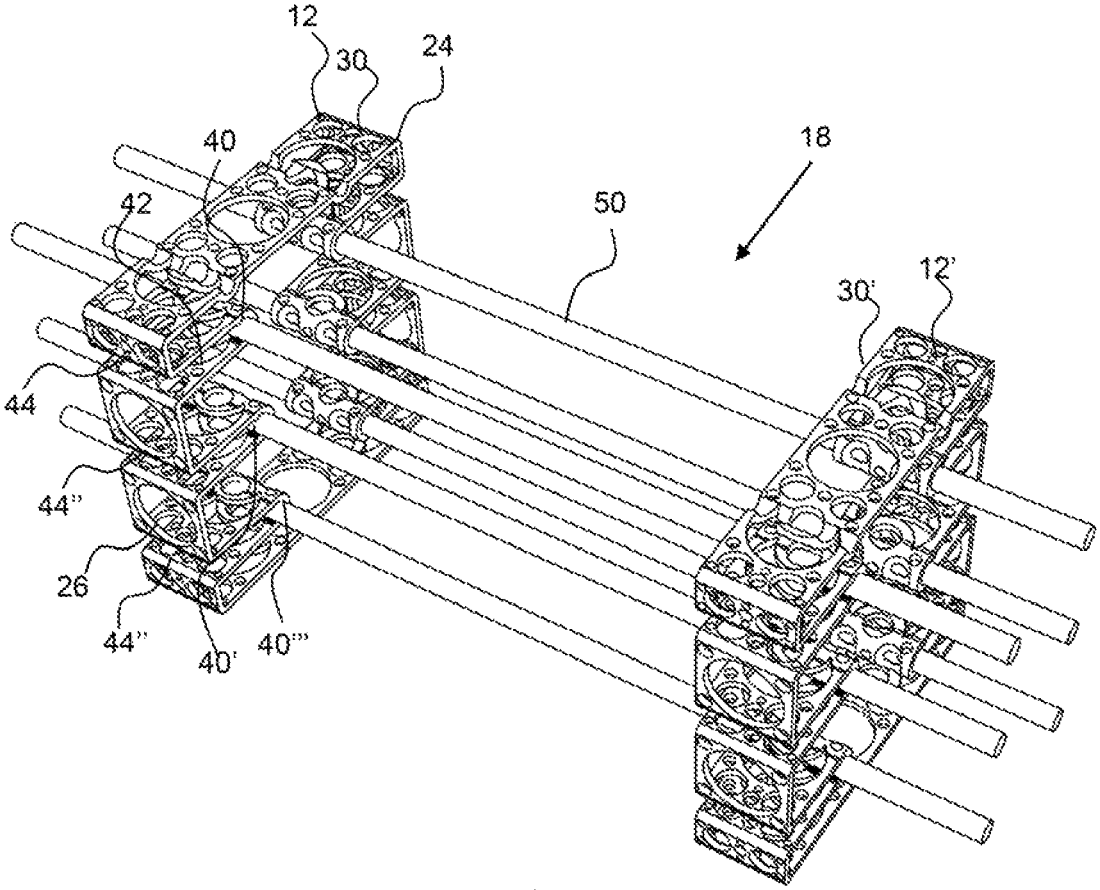
FIG. 4 shows an exemplary cementitious supporting form comprising a pair of concrete seismic foundation framers coupled together by rebar that extends through aligned rebar receiving retainers in each of the seismic foundation frames.

As shown in FIG. 4, an exemplary cementitious supporting form 18 comprises a pair of seismic foundation framers 12, 12' coupled together by rebar 50 that extends through aligned rebar retainers 40, 40' in each of the seismic foundation framers. The rebar may be slid into the rebar channel openings 44-44" and slid along the rebar channels 42 and accurately secured into the rebar retainers 40. As shown, the cementitious supporting form 18 has six rebar extensions secured and extending between the pair of seismic foundation framers. The rebar are secured an offset distance in from the perimeter of the frame, as may be required by some building codes.

Figure 5:
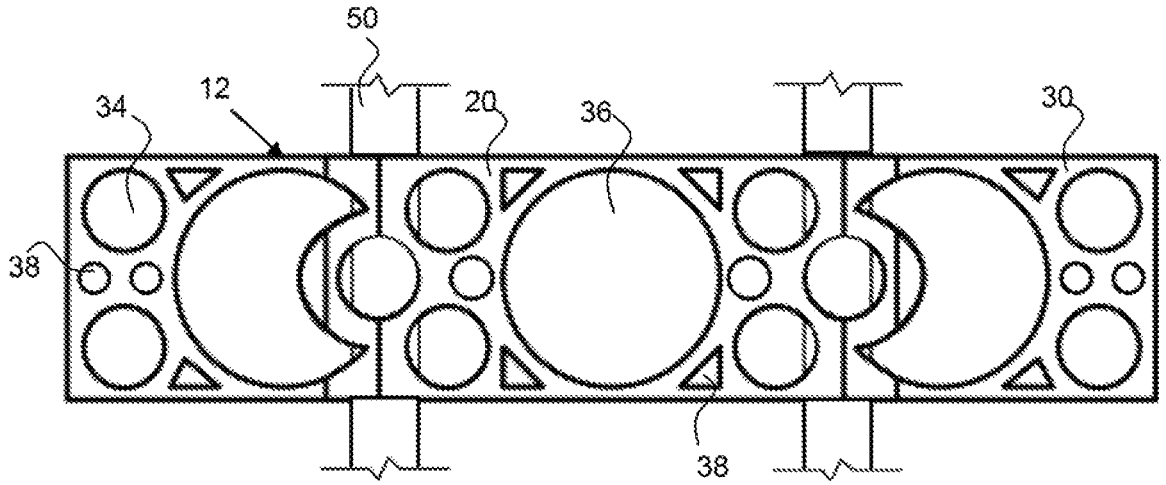
FIG. 5 shows a top view of an exemplary seismic foundation framer.

As shown in FIG. 5, an exemplary seismic foundation frame has a plurality of fastener openings 38, a plurality of structural pin openings 36 and a plurality of rebar openings 34.

Figure 6:
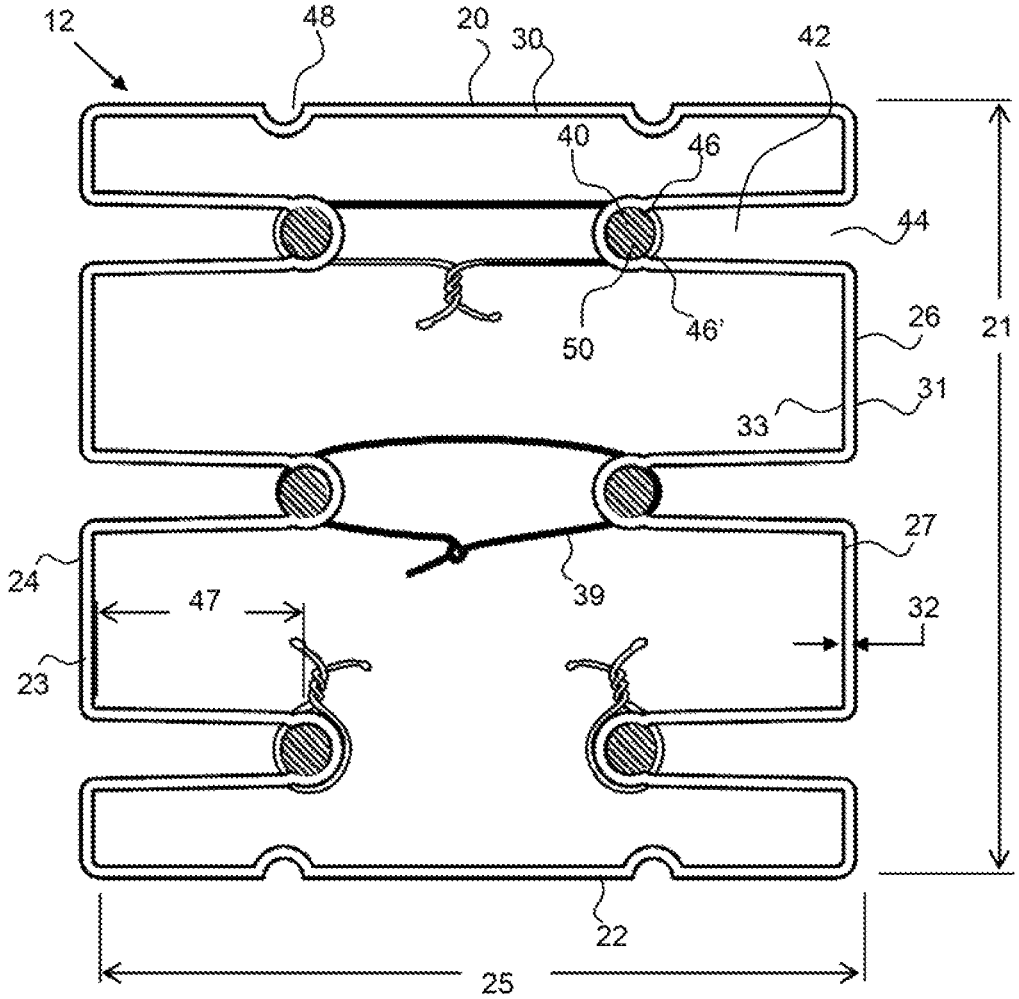
FIG. 6 shows a front surface view of an exemplary seismic foundation framer having rebar retained in the rebar retainers and cross-ties (define as wire ties or zip ties) configured around the opposing rebar retainers.

As shown in FIG. 6, an exemplary seismic foundation framer 12 has rebar 50 retained in the rebar retainers 40 and fasteners 39, such as cross-ties including wire ties or zip ties, configured around the opposing rebar retainers An exemplary seismic foundation framers 12 has rebar 50 accurately retained in the rebar retainers 40 an offset distance 47 from the outer perimeter 23, or the sides of the seismic foundation framer 12, which is an pre-engineered distance to the retaining protrusions 46. The exemplary seismic foundation framer 12 has a perimeter and six rebar retainers 40 formed by a single ribbon 30 that is continuous. The rebar retainers are formed by the ribbon extending in from the outer perimeter to form a rebar retaining channel 42 having a channel opening 44 in the outer perimeter. The exemplary seismic foundation framer also has a plurality of rebar recess 48 in the outer perimeter that may form rebar receiving openings between two adjacent frames, such as when the frames are stacked and secured together one atop another. The exemplary frame 12 has a height 21 from a bottom 22 to a top 20, a width 25 from a first side 24 to a second side 26 and a thickness 32 from an outside surface 31 to an inside surface 33. The frame is generally rectangular shaped having a rectangular shaped outer perimeter.

Figure 7:
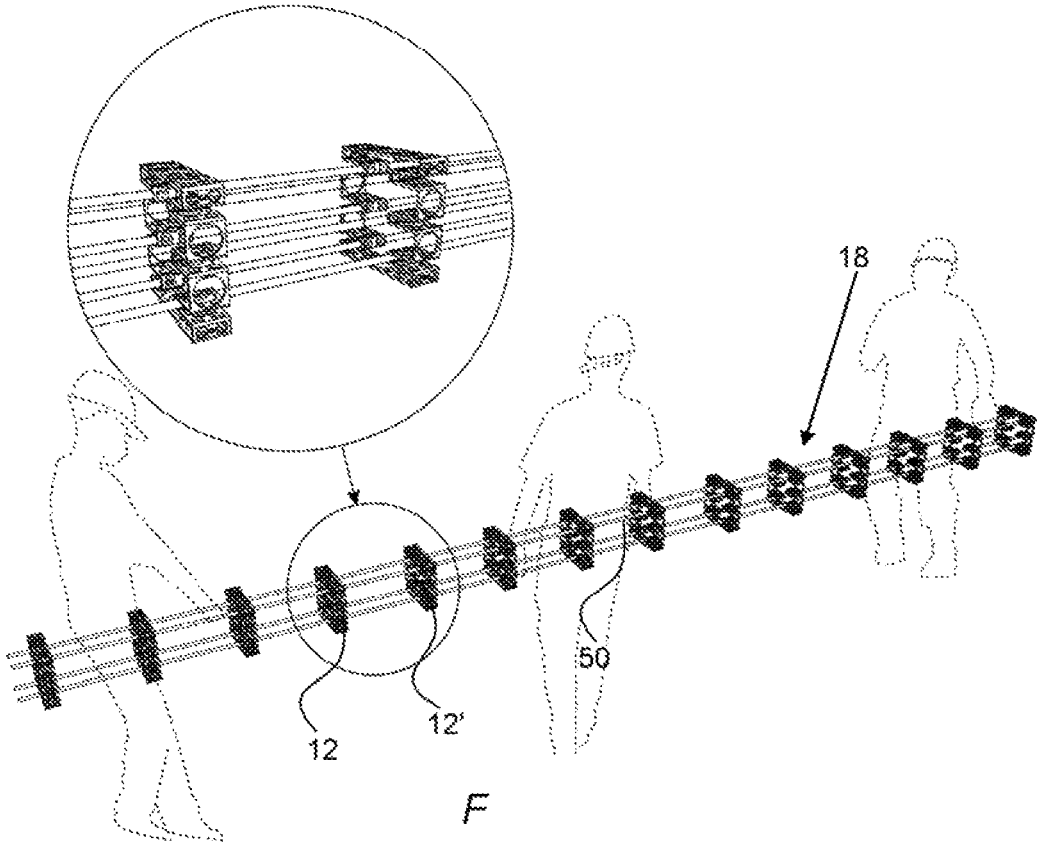
FIG. 7 shows an exemplary quickly assembled and lightweight cementitious supporting form having fourteen spaced apart, as needed, seismic foundation framers and about 20 feet of length that is being transported by three onsite workers for positioning in place on top of a containment sleeve (not shown).

As shown in FIG. 7, an exemplary cementitious supporting form 18 comprises a plurality of seismic foundation framers 12 coupled together by rebar 50 that extends through aligned rebar retainers in each of the seismic foundation frames.

Figure 8:
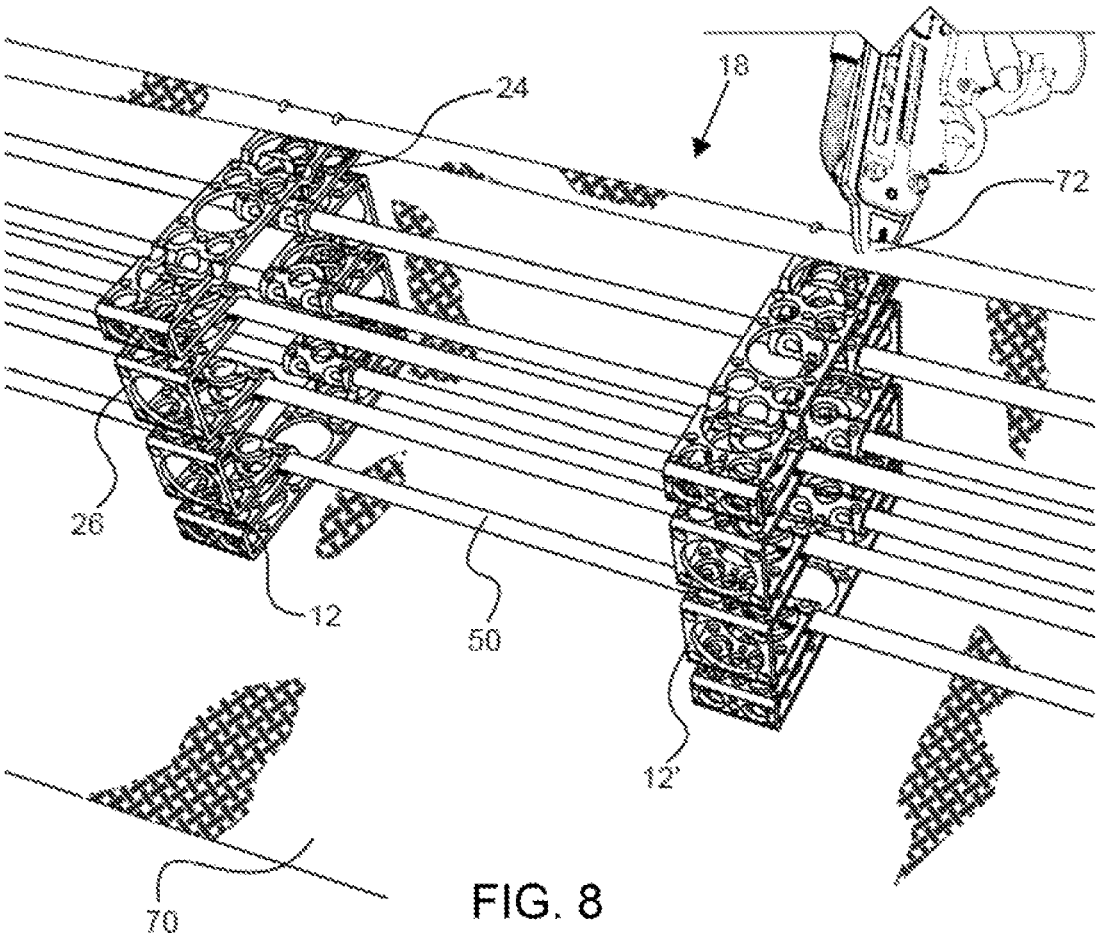
FIG. 8 show a perspective view of an exemplary cementitious supporting form having the containment sleeve being attached by a hog ring gun securing the partially installed and secured pre-manufactured containment sleeve that is scaled as needed to the seismic foundation framer with a hog ring/bull nose ring having many possible securement locations.

As shown in FIG. 8, an exemplary cementitious supporting form 18 has the containment sleeve 70 attached by sleeve retainers 72 to the frames. An exemplary sleeve retainer may be a hog ring, such as a metal ring, that extends through the sleeve and around a portion of the frame, such as through a fastener opening 38 in the seismic foundation framer 12. The sleeve is attached to the frame on a first side 24, and then is folded up along the second side 26 and secured to form a containment sleeved form for receiving concrete. The concrete will be retained by the sleeve and will flow through the frames and around the rebar to produce reinforced concrete structure. The sleeve may be secured along the height of a frame in a plurality of locations.

Figure 9:
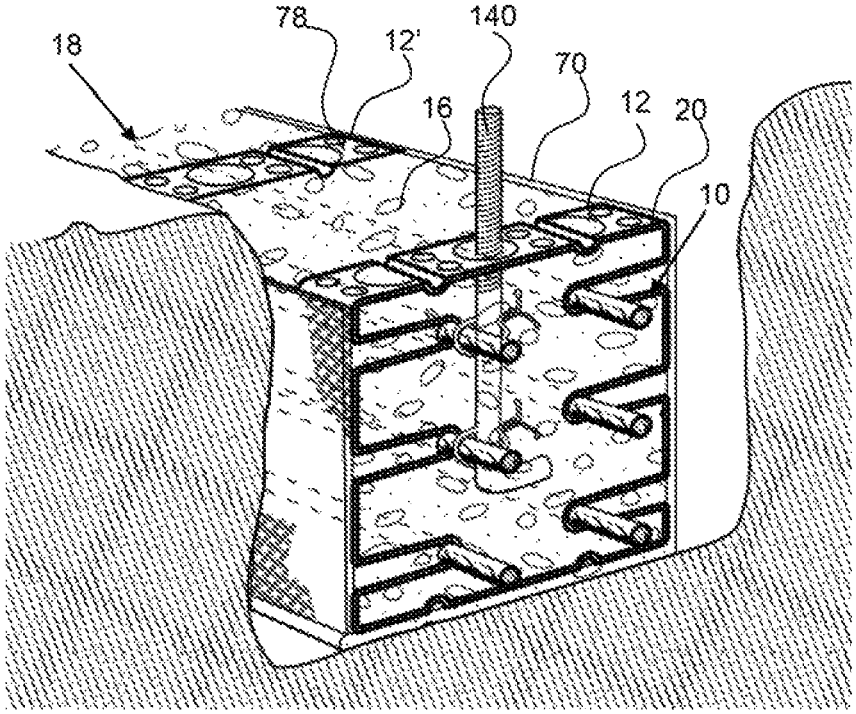
FIG. 9 shows a perspective view of an exemplary cementitious supporting form in a below grade foundation, in a trench, having two cast in place seismic frames, reinforcements, threaded sill bolt (screw pile bolt), and an attached containment sleeve.

As shown in FIG. 9, an exemplary cementitious supporting form 18 is configured in a below grade foundation, in a trench, having a plurality of seismic foundation framers 12 coupled together by rebar 50 and a threaded sill bolt 140 (screw pile bolt), extending through an opening in the seismic foundation framer, and an attached containment sleeve 70. The exemplary cementitious supporting form 18 has six rebar 50 extending through a plurality of rebar retainers 40 of aligned reinforcing frames 12 and a containment sleeve 70 extending around the frame to produce a sleeved containment form 78 to secure the concrete and rebar therein. As shown, the six rebar extends through the rebar retainers 40 at a pre-engineered distance from the outer perimeter. The threaded sill bolt 140 may be used for attachment to another form or to some other article, such as an article having a threaded opening.

Figure 10:
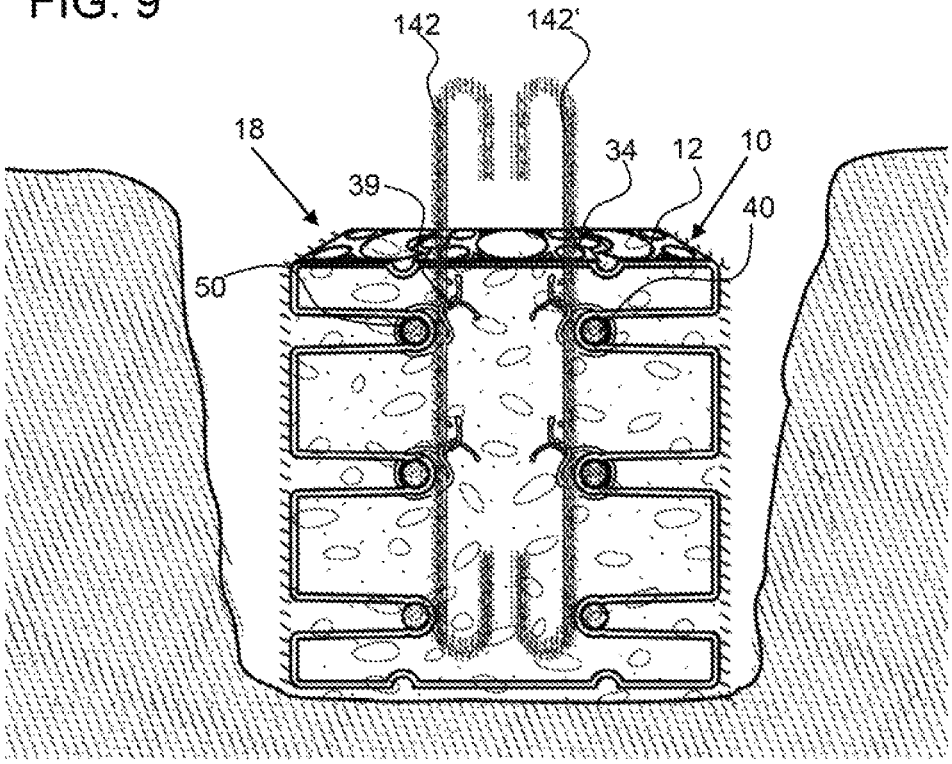
FIG. 10 shows a cross sectional view of an exemplary cementitious supporting form in a below grade foundation having optional installed cast in place and secured seismic hooks/seismic stirrups secured with wire ties.
Figure 11:
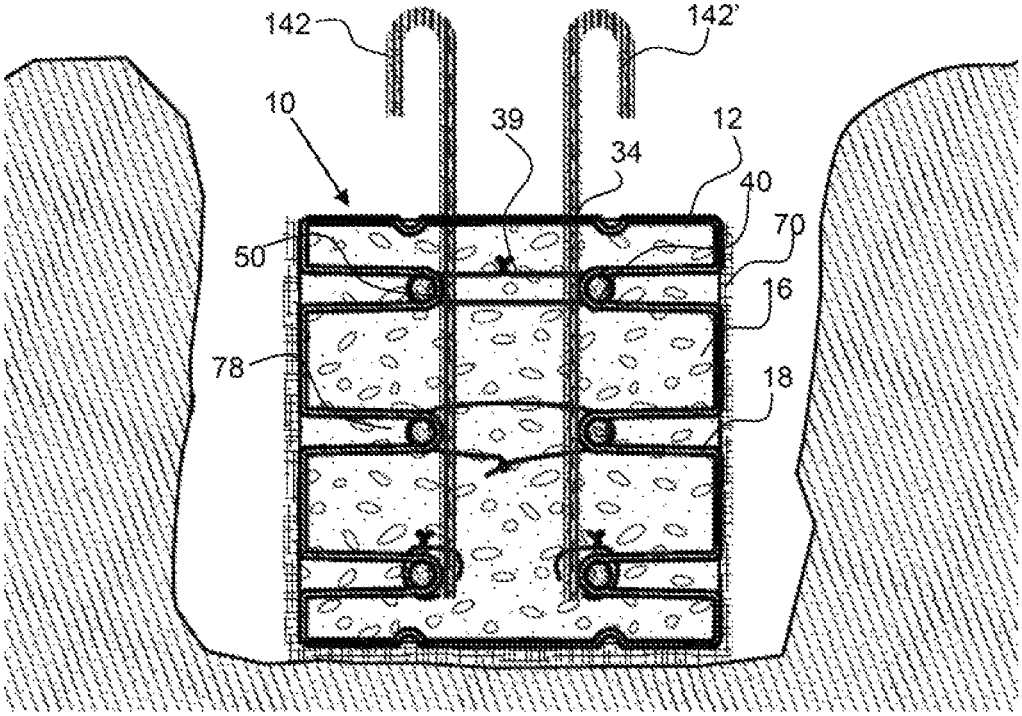
FIG. 11 shows a cross sectional view of an exemplary cementitious supporting form in trench for forming a below grade foundation and having a seismic foundation framer with two positioned and secured seismic hooks attached thereto and secured with wire ties. Other attachment systems are encompassed by the inventive system (not shown).

As shown in FIGS. 10 and 11, an exemplary cementitious supporting form 18 is in a below grade foundation. A pair of seismic hooks/seismic stirrups 142 are secured with fasteners 39 to the seismic foundation framer 12 and may extend through an opening in the seismic foundation framer, such as a rebar opening 34. A containment sleeve 70 extending around the seismic foundation framer to form a sleeved form 78.

Figure 12:
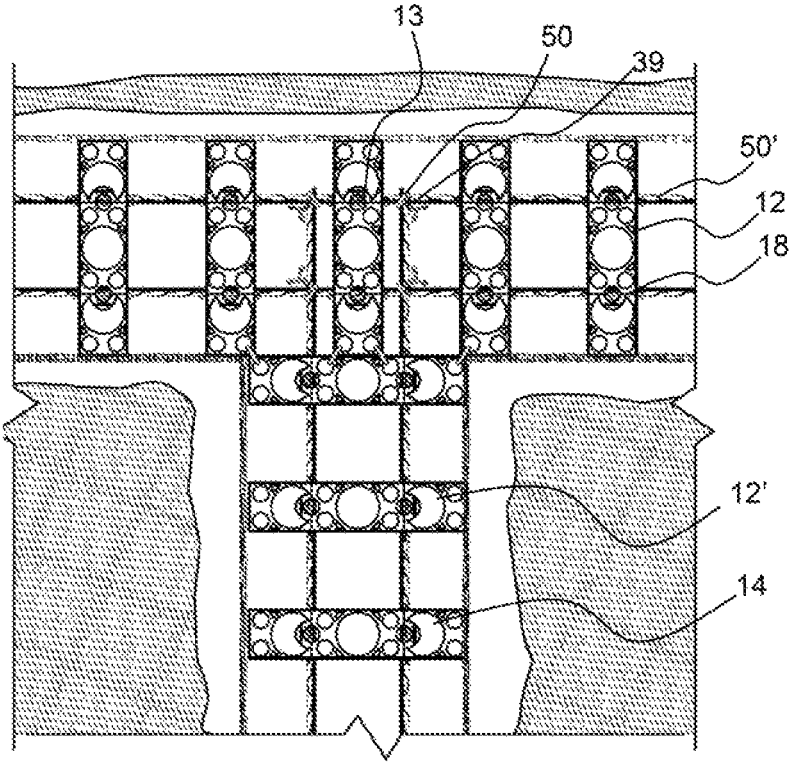
FIG. 12 show a top view of an exemplary cementitious supporting form in a sub grade placement with a plurality of seismic foundation framers spaced apart in a series and coupled together by rebar to form intersecting foundation/footing modules in a 90 degree configuration and secured together such as with bull nose ring and wire ties.

As shown in FIG. 12, an exemplary cementitious supporting form 18 in a sub grade placement with a plurality of seismic foundation framers 12 spaced apart in a series and coupled together by rebar 50 to form intersecting foundation/footing modules 13 and 14 in a 90 degree configuration and secured together such as with bull nose ring and wire ties. The rebar 50 extends from the second module 14 into the first module 13 and is secured to rebar 50' by a fastener 39, such as a wire tie.

Figure 13:
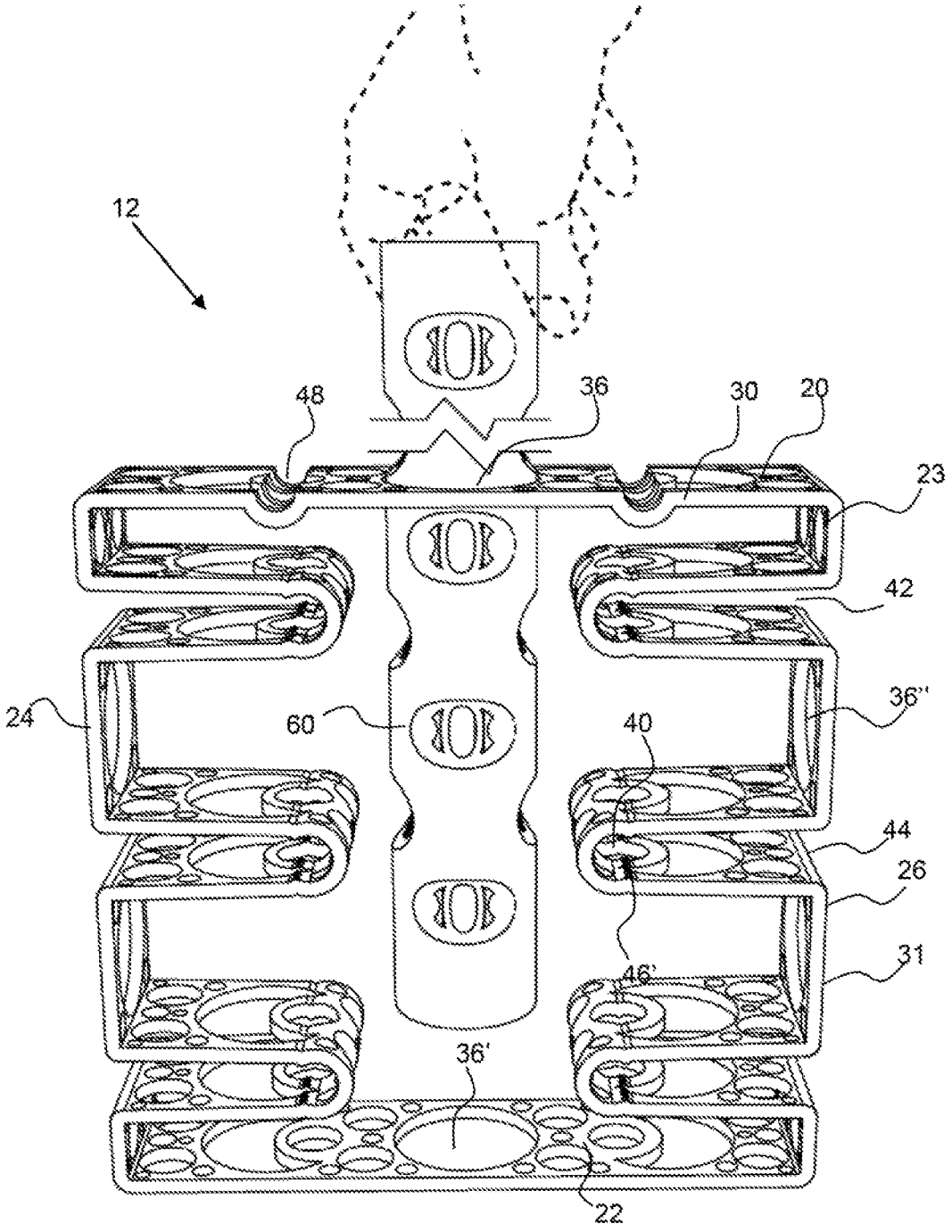
FIG. 13 shows a perspective view of an exemplary seismic foundation framer having a pin being inserted through a pin opening.

As shown in FIG. 13, an exemplary seismic foundation framer 12 has a structural pin 60 inserted through a pin opening 36 in the top 20 and may have length to enable the pin to extend through the pin opening 36' in the bottom 22 of the frame. A pin may be used to provide additional structural displacement and support and may extend from the frame into a secondary support and may be used to align adjacent frames, wherein one frame is secured in close proximity to or in contact with another frame. For example, a plurality of frames may be stacked one atop another and a pin may extend horizontal and vertically through all the of the stacked frames to provide alignment and displacement and support. A pin may be larger in cross-length dimension than rebar, such a more than twice as large or more, or as much as about three times as larger or more or even about five times larger or more, and any suitable range between and including the values provided.

Figure 14:
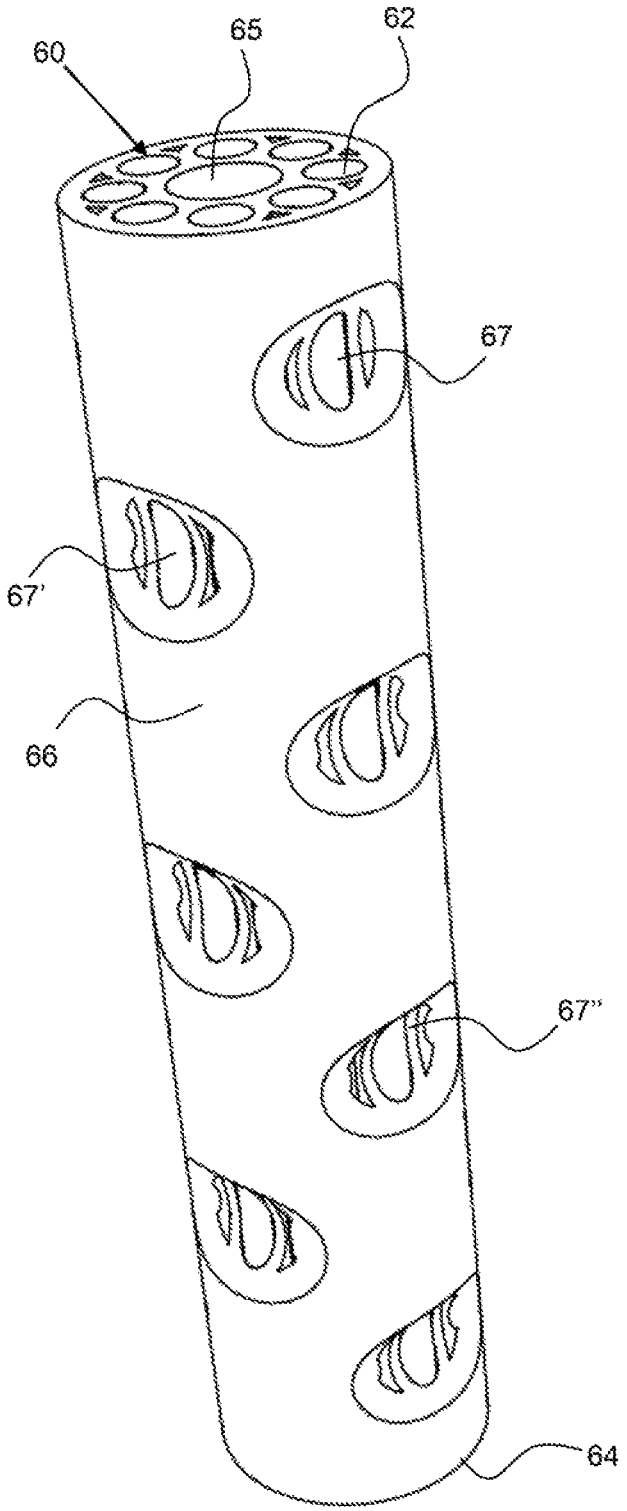
FIG. 14 shows a perspective view of an exemplary pin having nine receiving ports for interlocking structural pins.

As shown in FIG. 14, an exemplary structural pin 60 has a plurality of end openings 65 on the first end 62 and second end 64 of the pin. The openings may extend through the pin from the first end to the second end. The pin also has a plurality of surface openings 67 that extend through the outer surface 66. The surface openings 67 may be used for receiving cementitious material, rebar, another pin and the like.

Figure 15:
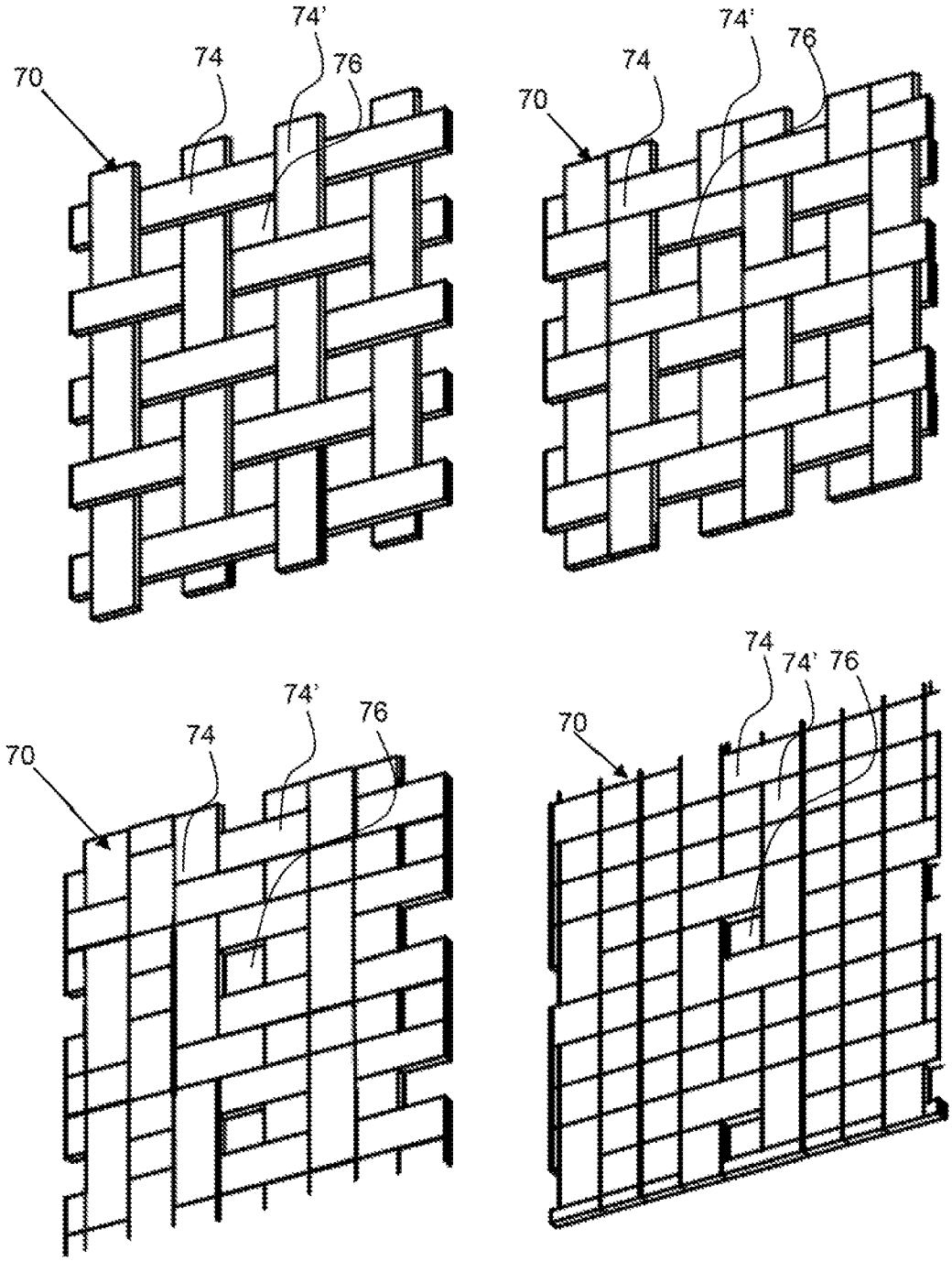
FIG. 15 shows four exemplary sleeves with different filaments and different filament spacings defining the pre-engineered venting apertures as needed to optimize the specific mix curing environment and provide external reinforcement.

As shown in FIG. 15, four exemplary containment sleeves 70 have different stands 74, 74' and different strand spacings and weaves that define the pre-engineered venting apertures 76 as needed to optimize the specific mix curing environment and provide external reinforcement. The strands may be yarns, or flat ribbons of material, such as flat ribbons of polymer material or basalt. As shown, the containment sleeves depicted have different combinations of small generally square pre-engineered venting apertures and generally elongated rectangular pre-engineered apertures. The dimension of the venting aperture is the largest dimension across the aperture, such as the width, or length of the aperture, or diagonal line from one corner to an opposing corner, or a diameter.

Figure 16:
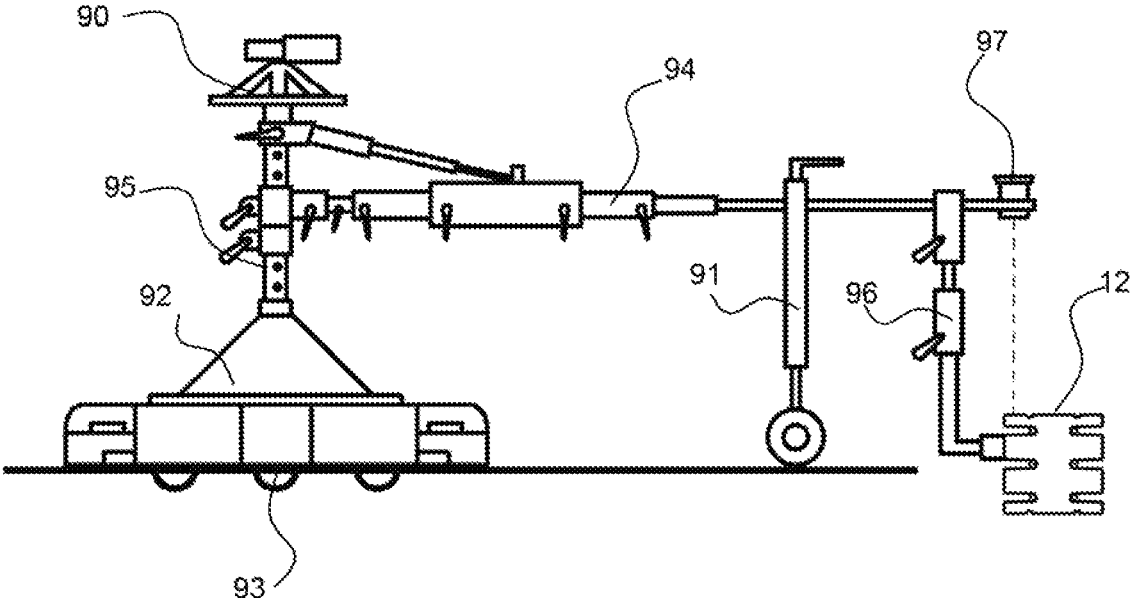
FIG. 16 shows a side view of an exemplary accurate seismic framer positioning apparatus having adjustable telescoping, extendable and retractable, arm having a reusable water and/or sand filled transportable securement and operating pedestal having arms having an adjustable positioning and supporting wheel.

FIG. 16 shows a side view of an exemplary accurate seismic framer positioning apparatus having adjustable telescoping, extendable and retractable, arm having a reusable water and/or sand filled transportable securement and operating pedestal having arms having an adjustable positioning and supporting wheel or other structure constructed on the foundation.

Figure 17:
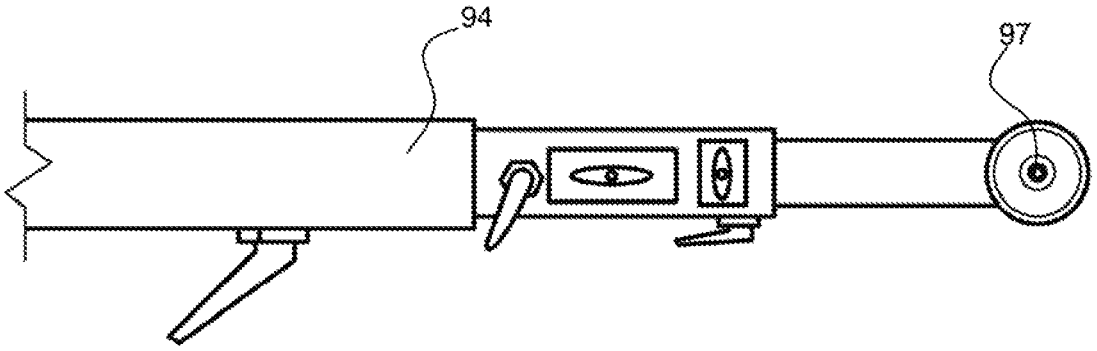
FIG. 17 show a top view of the accurate seismic framer positioning apparatus shown in FIG. 16.
Figure 18:
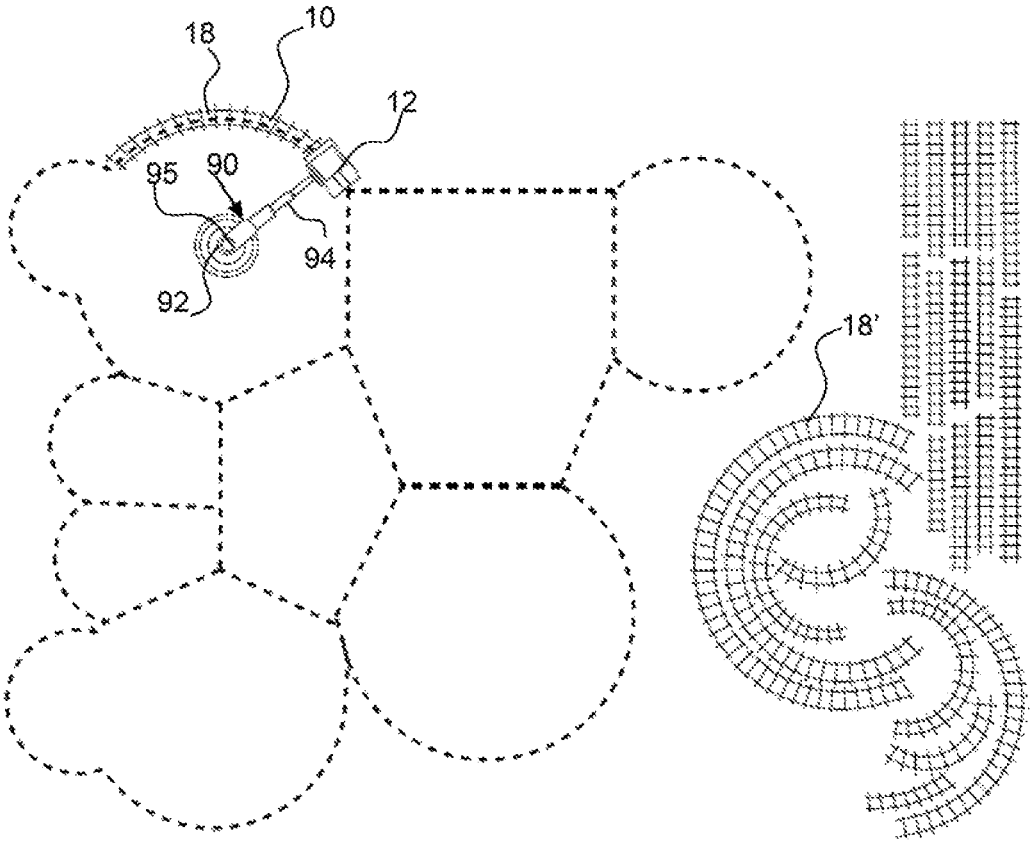
FIG. 18 shows an overhead view of an exemplary seismic framer positioning apparatus accurately placing an exemplary cementitious supporting form as described herein.

As shown in FIGS. 16 to 18, an exemplary accurate seismic framer positioning apparatus 90 has adjustable telescoping, extendable and retractable, arm 94, 96. The exemplary seismic framer positioning apparatus 90 has a base 92, a horizontal arm 94 and vertical arm 96 for accurate positioning and placement of seismic foundation framers 12 and/or cementitious supporting forms. The exemplary frame positioner 90 has a base 92, a horizontal arm 94 and vertical arm 96 for accurate positioning and placement of frames 12 and/or forms. The exemplary seismic framer positioning apparatus 90 is rotationally coupled to a base coupling 93 and the extendable horizontal arm 94 may move back and forth from the frame tower 95 to position the frame 12 or form. The horizontal arm may be telescoping or comprise any suitable motion feature for extending the arm away and back towards the frame tower. A support arm 91 is configured between the frame tower 95 and the vertical arm 96. The vertical arm may move up and down from the horizontal arm and a sensor 97 may be used to determine a depth or vertical position of the frame. The seismic framer positioning apparatus 90 is detachably attachable to the base coupling 93.

FIG. 18 shows one of several possible supporting and operating platforms/pedestals centrally positioned within a proposed curvilinear foundation/footing illustrating the pre-bent rebar having seismic frames secured thereto for proposed rooms or structure illustrates one of many possible locations and configurations (other positions are conceived within the current invention) for accurately assisting in indicating and positioning the pre-assembled modular frames, reinforcements, and containment sleeve(s). Note: initially placing on top of the sleeve and then folding the containment sleeve around (making a 3-dimensional concrete form). As shown in FIG. 18, the exemplary seismic framer positioning apparatus 90 is used to accurately locate the cementitious supporting form for formation of the foundation 10. The exemplary frame positioner can rotate about the base and move away from the frame tower 95 to allow formation of curved foundations. A number of base couplings may be configured around the foundation area to allow precise positioning of the frames and forms.

Figure 19:
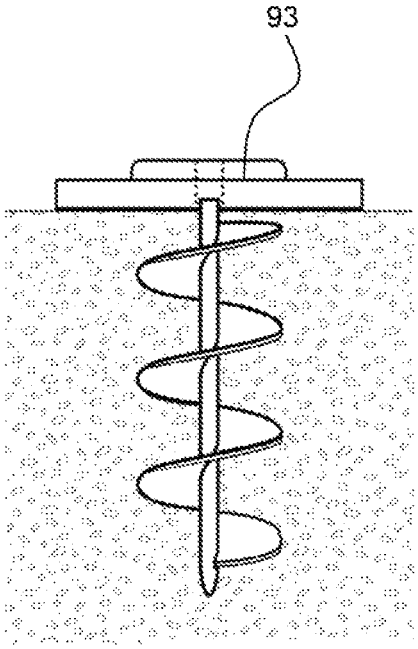
FIG. 19 shows a side view of an exemplary base coupling comprising a temporarily installed auger drilled onsite in place and having a universal mounting attachment that provides quickly detachable attachment of the seismic framer positioning apparatus.
Figure 20:
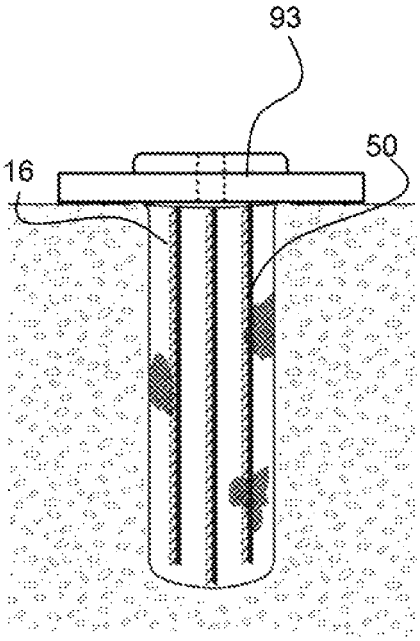
FIG. 20 a side view of an exemplary base coupling that is a cast in place leave in place base coupling comprising an operating column made by drilling and removing the soil and installing three or more reinforcement bars inside of a pre-engineered containment sleeve (tube) to improve ground pedestal surface engagement.

As shown in FIGS. 19 and 20, exemplary base couplers 93 are configured in the ground to provide a stable base and fixed position for the frame positioner. As shown in FIG. 19, an auger style extension is in the ground to provide a fixed position and secure base. As shown in FIG. 20, a base comprises rebar 50 and cementitious material 16, such as concrete, to provide a fixed position and secure base. An exemplary seismic framer positioning apparatus 90 may be detachably attachable to the auger type base coupler to support and operate the seismic framer positioning apparatus as needed. The auger type base coupler may be a temporarily installed onsite and have a universal mounting attachment that provides quickly removable securement to the supporting, positioning, and operating platform/pedestal having bubble levels, a compass, level indicators, that is removably attached to the auger to support and operate the seismic framer positioning apparatus as needed.

As shown in FIG. 20 the exemplary base coupler 93 is a cast in place leave in place base coupler comprising an operating column made by drilling and removing the soil and installing three or more reinforcement bars inside of a pre-engineered containment sleeve (tube) to improve ground pedestal surface engagement.

Figure 21:
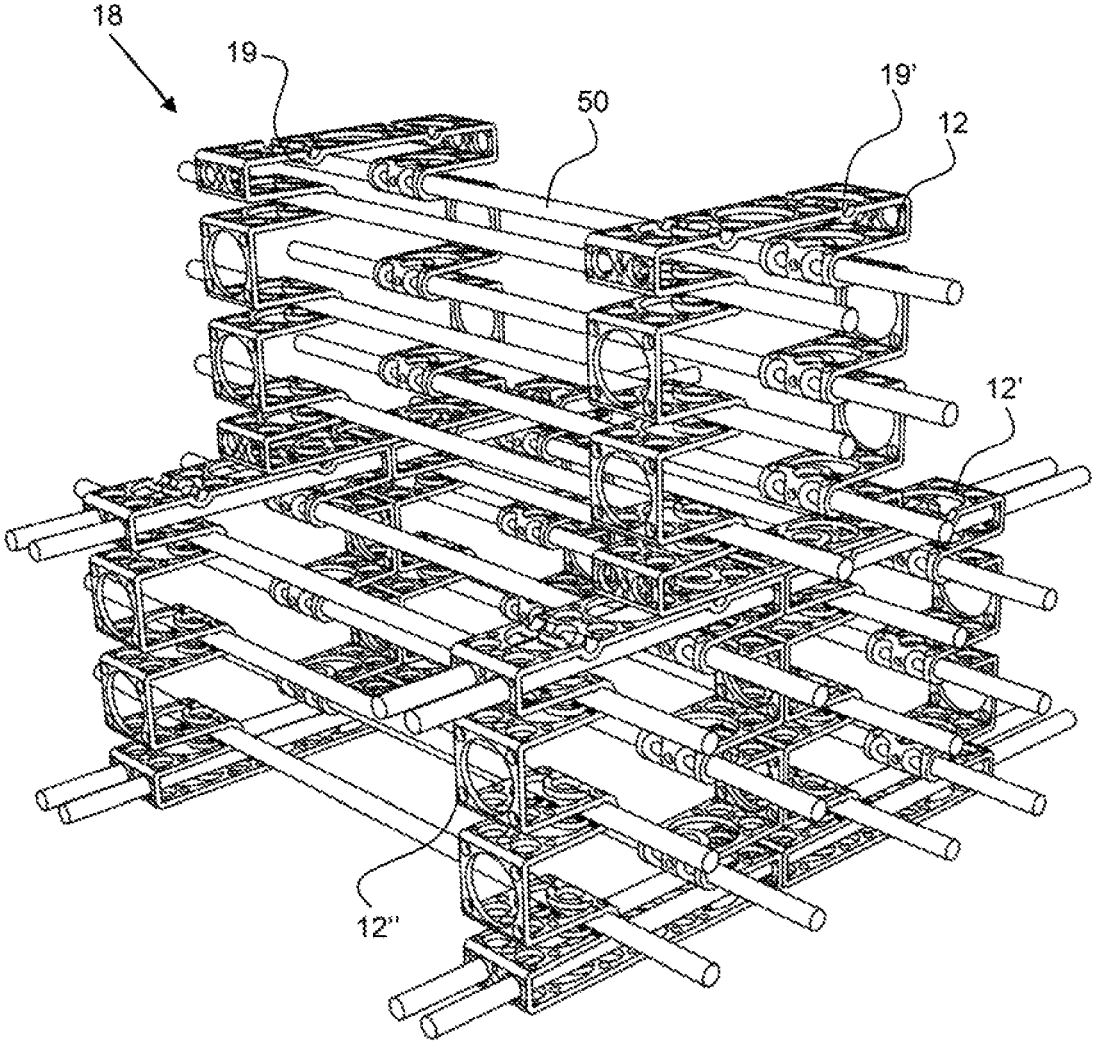
FIG. 21 show a perspective view of an exemplary cementitious supporting form comprising a pair of seismic foundation framer assemblies, each comprising three seismic foundation framers, wherein the assemblies are positioned and secured together by rebar extending between the offset pairs.

As shown in FIG. 21, an exemplary cementitious supporting form 18 comprises a pair of seismic foundation framer assemblies 19-19', each comprising three seismic foundation framers 12-12", wherein the assemblies are positioned and secured together by rebar 50 extending between the offset pairs. The seismic foundation framers 12 may be stacked or secured next to each other to form an assembly of a required size for the application.

Figure 22:
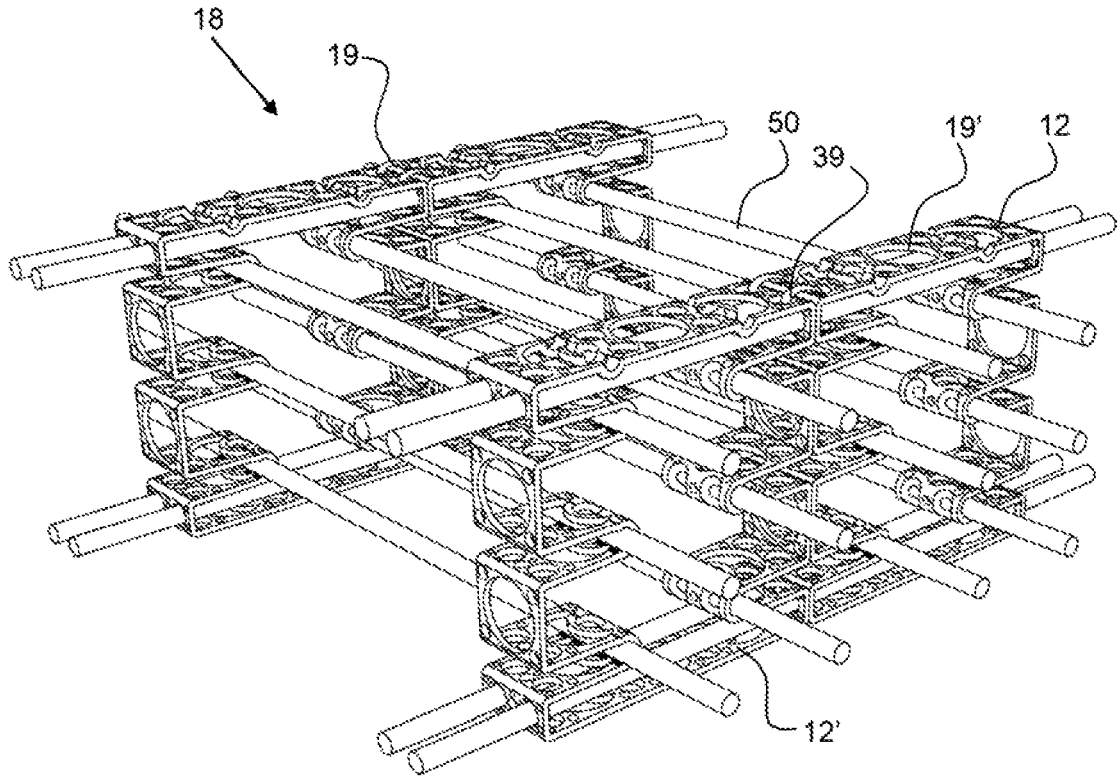
FIG. 22 a perspective view of an exemplary cementitious supporting form comprising a pair of seismic foundation framer assemblies coupled together by an fastener, such as a hog ring, as shown, and positioned at an offset distance from each other and secured together by rebar extending through rebar retainers.

As shown in FIG. 22, an exemplary cementitious supporting form 18 comprises a pair of seismic foundation framer assemblies 19-19', each comprising two seismic foundation framers 12-12', wherein the assemblies are positioned and secured together by rebar 50 extending between the offset pairs. The seismic foundation framers 12 may be stacked or secured next to each other to form an assembly of a required size for the application.

Figure 23:
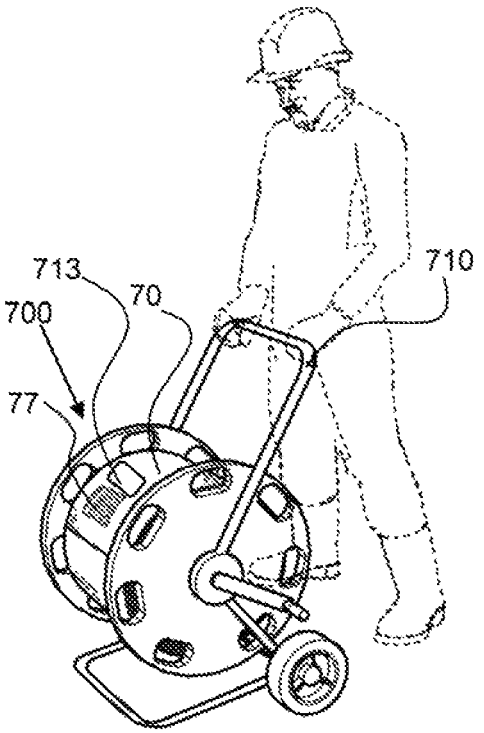
FIG. 23 shows a worker transporting a pre-manufactured spooled containment sleeve with an onsite dispensing system in a closed transporting position having a winding handle and ratcheting crank, and depicting a QR code.

As shown in FIG. 23, a worker is transporting a pre-manufactured spooled containment sleeve 70 with an onsite dispensing system 700 in a closed transporting position having a winding handle 710 and ratcheting crank.

Figure 24:
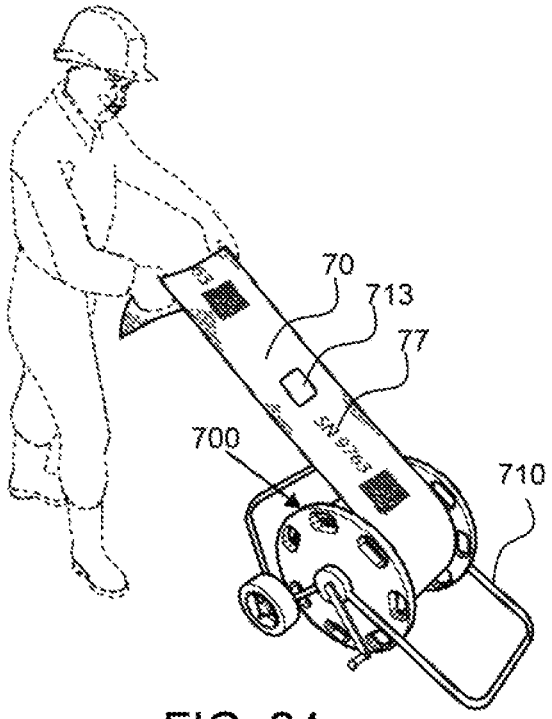
FIG. 24 shows a worker unspooling the pre-manufactured spooled containment sleeve from the dispensing system with the handle is folded down to secure the dispensing system in place.
Figure 25:
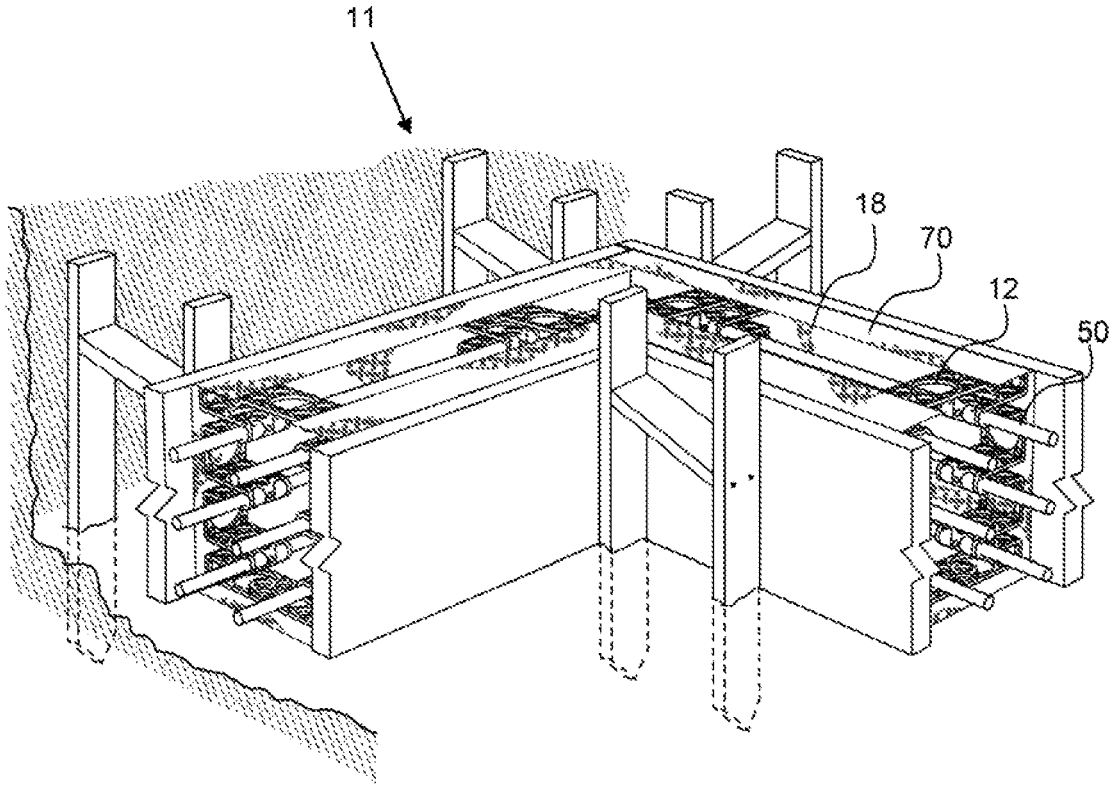
FIG. 25 shows an installed above grade seismic framer system having four modular frames and six reinforcing bars and containment mesh fully assembled and installed within a conventional foundation footings wooden form having conventional supporting stakes.

Referring now to FIGS. 24 and 25, a spooled containment sleeve 70 is moved to a desired location and is dispensed from a dispensing system 700. The containment sleeve has translucent windows 713 to allow viewing of the cementitious material therethrough, as well as the seismic foundation frames. As shown in FIG. 24, a worker is unspooling the pre-manufactured spooled containment sleeve 70 from the dispensing system 700 with the handle 710 in a folded down configuration to secure the dispensing system in place. The containment may have markings 77, such as distance markings, or manufacturer names or icons, or QR codes and the like. As shown in FIG. 25, an installed above grade seismic framer system 11 has four seismic foundation framers 12, six rebar 50 and containment sleeve 70 assembled into a cementitious supporting form 18 and installed within a conventional foundation footings wooden form having conventional supporting stakes.

Figure 26:
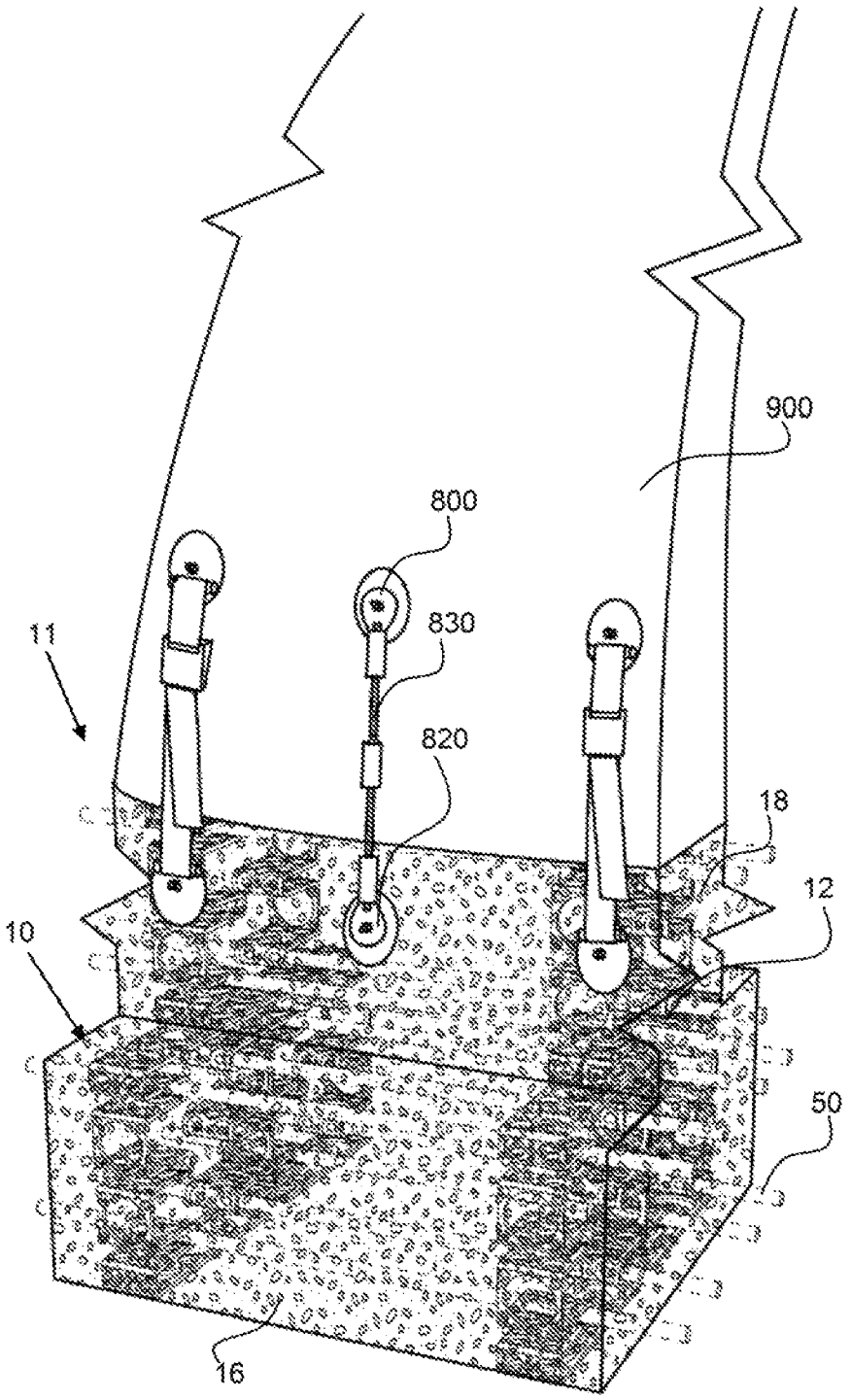
FIG. 26 show an exemplary above grade cementitious supporting form comprising a plurality of seismic foundation framer assemblies positioned and secured together and having twelve reinforcement bars.

As shown in FIG. 26, an exemplary above grade cementitious supporting form 18 comprises a plurality of seismic foundation framer assemblies 12 positioned and secured together and having twelve rebar 50. The cementitious supporting form 18 comprises fastener couplers 820 that allow attachment of fastener extensions 830 to a secondary article, such as an air form 900. An attachment 800 on the air form allows the air form to be secured in place by the cementitious supporting form 18. are removably secured via pre-engineered attachment points having one adjustable cable/securement system attached to a removable attachment bolt and two adjustable straps/securement system attached to the sleeve and frame to position and attach to an above reusable and or leave in place cast in place air form structure. Note containment sleeve not shown for illustrative purposes.

Figure 27:
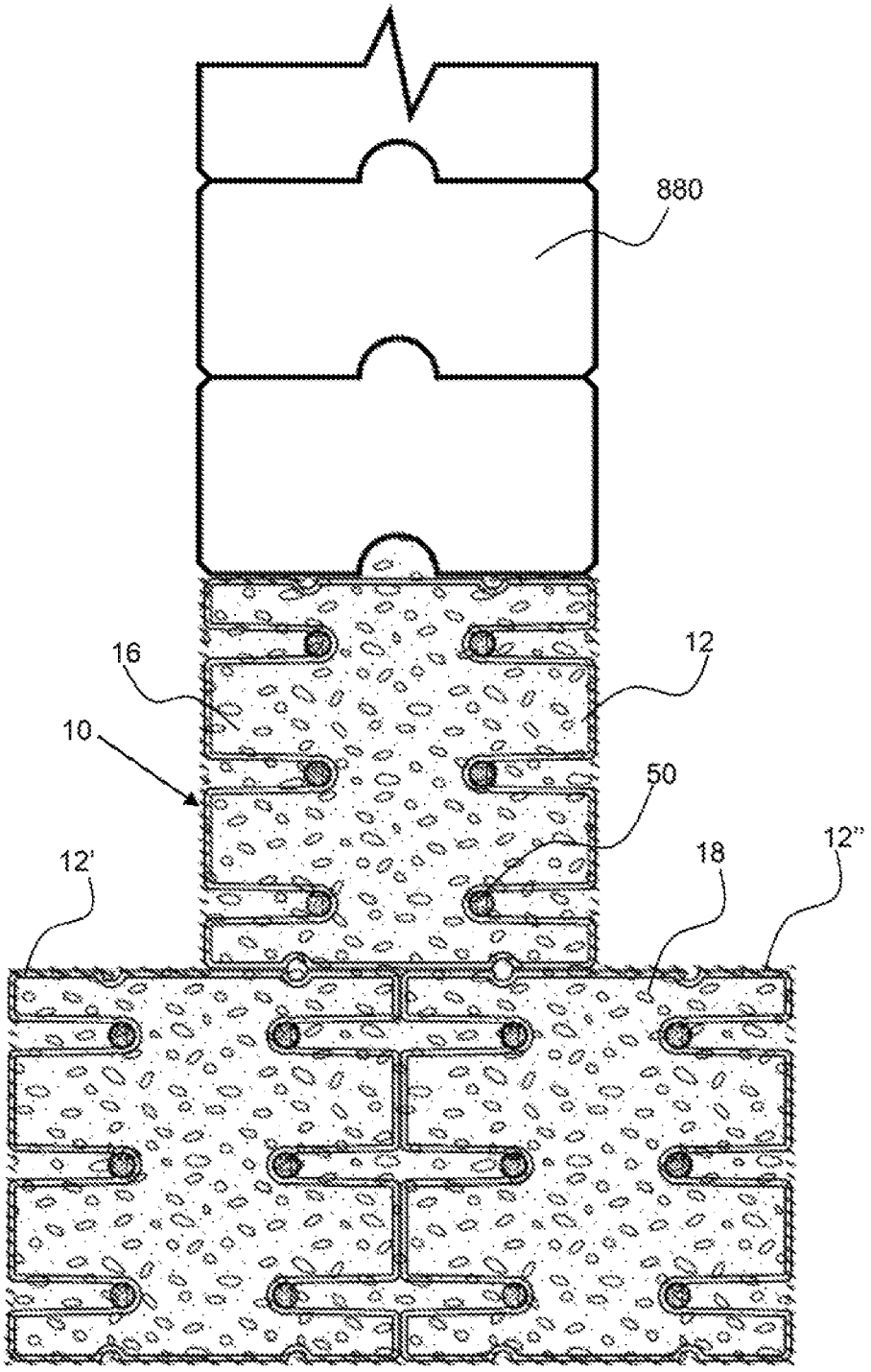
FIG. 27 shows cross sectional view of an exemplary cementitious supporting form comprising three seismic foundation framers positioned and secured together.

As shown in FIG. 27, an exemplary cementitious supporting form 18 comprises three seismic foundation framers 12-12" positioned and secured together, eighteen rebar 50 extending through rebar retainers and filled with a micro-reinforced cementitious mix 16. An exemplary 3D printed structure 880, such as long bricks having keyway interlocking characteristics are printed thereon. Containment sleeve not shown for illustrative purposes.

Figure 28:
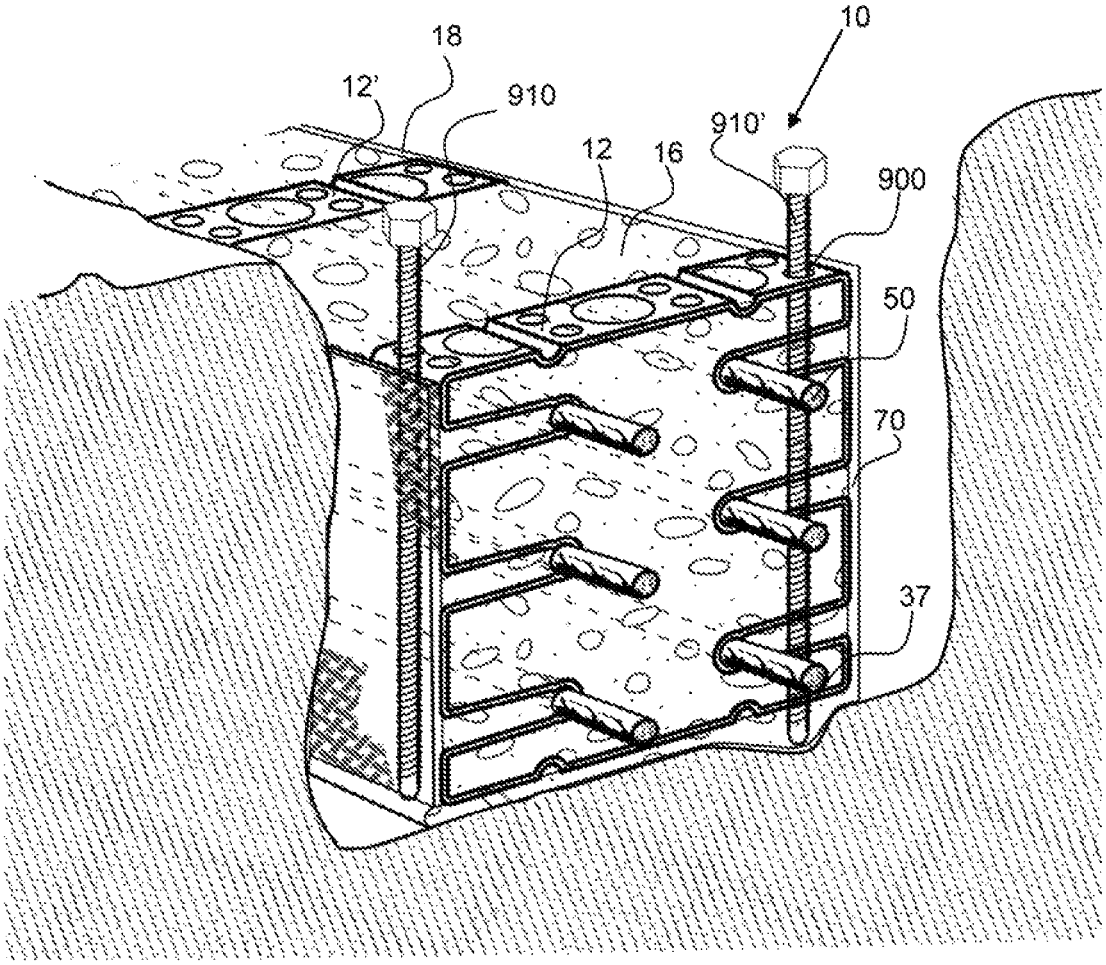
FIG. 28 shows a perspective view of a portion of an exemplary cementitious supporting form in a below grade foundation, in a trench, having two cast in place seismic foundation frames, an attached containment sleeve and two leveling bolts extending through frame openings to level the frame.

As shown in FIG. 28, an exemplary cementitious supporting form 18 is used to create a below grade foundation 10, in a trench, having two cast in place seismic foundation frames 12, 12', an attached containment sleeve 70 and two leveling bolts 910, 910' extending through frame openings 900 to level the frame. A frame opening may be a threaded frame opening 37 to allow the leveling bolt to apply force to the frame 12 and supporting form. As shown, the trench is not level and leveling bolt 910 is extended from the bottom of the frame 12 to level the frame. Also, the extended end of the leveling bolt is rounded and exerts force on the containment sleeve 70. Note that one or more leveling bolts may be inserted through the frame for the purposes of changing a position or orientation of the frame or form. A leveling bolt may be inserted vertically, as shown, or horizontally through the frame. A leveling bolt extending horizontally through the frame may be used to change a horizontal position of the frame or form, such as a setback or to align the frame or form with a desired position. In addition, leveling bolts may be used for attachment to another structure, such as an above structure, wherein the leveling bolts extend into the above structure. In an exemplary embodiment, the leveling bolts extend through an opening in a frame or other structural component in an adjoined structure.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A seismic foundation framer comprising a frame having:

a) a top;
b) a bottom;
c) a first side;
d) a second side;
e) a first surface;
f) a second surface;
g) a perimeter; and
h) a plurality of rebar retainers configured a pre-engineered offset distance from the perimeter of the frame, each rebar retainer comprising a retaining protrusion to accurately secure rebar with a length axis of the rebar extending through the frame from said first surface to said second surface, and wherein the perimeter has a rebar retainer indentation for accurately receiving rebar into the rebar retainer;

i) at least one rebar opening in the first side of the frame; and j) at least one rebar opening in the second side of the frame;

wherein the at least one rebar opening in the first side of the frame and the at least one rebar opening in the second side of the frame are aligned to receive rebar that extends therethrough; and k) a containment sleeve that extends under the frame and up the first and second sides to produce a containment sleeved form for receiving concrete therein.

2. The seismic foundation framer of claim 1, comprising a ribbon that extends contiguously about the perimeter to form said top, bottom, first side and second side, the perimeter and the plurality of pre-engineered rebar retainer.

3. A seismic foundation framer comprising a frame having:

a) a top;

b) a bottom;

c) a first side;

d) a second side;

e) a first surface;

f) a second surface;

g) a perimeter;

h) a ribbon that extends contiguously about the perimeter to form said top, bottom, first side and second side, the perimeter and the plurality of pre-engineered rebar retainer and i) a plurality of rebar retainers configured a pre-engineered offset distance from the exterior perimeter of the frame, each rebar retainer comprising a retaining protrusion to accurately secure rebar with a length axis of the rebar extending through the reinforcing frame from a first surface to a second surface, and wherein the perimeter has a rebar retainer indentation for accurately receiving rebar into the rebar retainer;

j) at least one rebar opening in the first side of the frame; and k) at least one rebar opening in the second side of the frame;

wherein the at least one rebar opening in the first side of the frame and the at least one rebar opening in the second side of the frame are aligned to receive rebar that extends therethrough;

wherein the each of the rebar retainers are formed from the ribbon that loops inward from the perimeter to produce an accurate rebar receiving channel having the retaining protrusion therein.

4. The seismic foundation framer of claim 3, comprising at least two rebar retainers that extend in from each of the first and second sides of the receiving frame.

5. The seismic foundation framer of claim 1, wherein the seismic foundation framer comprises a polymer.

6. The seismic foundation framer of claim 1, wherein the seismic foundation framer comprises basalt.

7. The seismic foundation framer of claim 1, wherein the seismic foundation framer comprises graphene.

8. The seismic foundation framer of claim 1, further comprising:

a) at least one rebar opening in the top of the frame; and b) at least one rebar opening in the bottom of the frame;

wherein the at least one rebar opening in the top of the frame and the at least one rebar opening in the bottom of the frame are aligned to receive rebar that extends therethrough.

9. The seismic foundation framer of claim 1, wherein the seismic foundation framer is freestanding wherein the seismic foundation framer will stand upright on the bottom without additional support.

10. A cementitious supporting form comprising:

a) a plurality of seismic foundation framers comprising a frame, each frame comprising a ribbon that extends contiguously about a perimeter to form a top, a bottom, a first side, a second side and a plurality of rebar retainers:

wherein each of the plurality of rebar retainers are formed from the ribbon that loops inward from the perimeter to produce a rebar receiving channel having the retaining protrusion therein;

wherein the plurality of rebar retainers are configured a pre-engineered offset distance from the perimeter of the frame, and wherein each rebar retainer comprises a retaining protrusion to accurately secure rebar with a length axis of the rebar extending through the seismic foundation frame from a first surface to a second surface; and wherein the perimeter has a rebar channel opening for receiving rebar into the rebar retainer channel and into the rebar retainer;

b) at least two rebar retained in said plurality of rebar retainers of each of adjacent frames and extending between the adjacent frames to construct said cementitious supporting form; wherein a first seismic foundation framer forms a base seismic foundation framer and a second seismic foundation framer configured on top of said first frame;

wherein each of the first and second frames comprise:

at least one pin opening in the top of the frame; and at least one pin opening in the bottom of the frame;

wherein the at least one pin opening in the top of the frame and the at least one pin opening in the bottom of the frame are aligned to receive a pin that extends therethrough; and wherein a single pin extends through the at least one pin opening in the top and bottom of both the first and second frames to retain the base seismic foundation framer to the second frame.

11. The cementitious supporting form of claim 10, further comprising a containment sleeve that extends between and under the plurality of frames and up the first and second sides to produce a containment sleeved form for receiving concrete therein.

12. The cementitious supporting form of claim 11, wherein the containment sleeve comprises a plurality of venting apertures that are spaced from each other a distance of no more than 5 mm.

13. The cementitious supporting form of claim 11, wherein the containment sleeve is made from a polymer.

14. The cementitious supporting form of claim 11, wherein the containment sleeve comprises graphene.

15. The cementitious supporting form of claim 11, wherein the containment sleeve comprises basalt.

16. The cementitious supporting form of claim 11, wherein the containment sleeve comprises a translucent window.

17. The cementitious supporting form of claim 10, wherein the containment sleeve comprises a QR code.

18. The cementitious supporting form of claim 10, wherein the rebar extending between adjacent frames is non-linear in an extended space between the adjacent frames.

19. The cementitious supporting form of claim 10, further comprising a leveling bolt extending through an opening in the frame to change a position of the frame.

20. The cementitious supporting form of claim 19, wherein said opening is a threaded opening and the leveling bolt is threaded into said threaded opening.

21. The cementitious supporting form of claim 1, wherein the rebar extending between adjacent frames is non-linear in an extended space between the adjacent frames.

* * * * *